US011015819B2

(12) United States Patent
Lee et al.

(10) Patent No.: US 11,015,819 B2
(45) Date of Patent: May 25, 2021

(54) OVEN

(71) Applicant: Samsung Electronics Co., Ltd., Suwon-si (KR)

(72) Inventors: Jung Hak Lee, Suwon-si (KR); Sang-Jin Lee, Hwaseong-si (KR); Yeon Hee Kook, Suwon-si (KR); Myoung Keun Kwon, Seoul (KR); Mee Ran Cho, Hwaseong-si (KR); Min Jae Lee, Suwon-si (KR); Jin Ho Jeong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 207 days.

(21) Appl. No.: 16/169,277

(22) Filed: Oct. 24, 2018

(65) Prior Publication Data

US 2019/0120504 A1 Apr. 25, 2019

(30) Foreign Application Priority Data

Oct. 25, 2017 (KR) ..... 10-2017-0139046

(51) Int. Cl.
*F24C 15/32* (2006.01)
*F24C 15/20* (2006.01)
*F24C 7/06* (2006.01)

(52) U.S. Cl.
CPC ..... *F24C 15/325* (2013.01); *F24C 15/2035* (2013.01); *F24C 7/067* (2013.01)

(58) Field of Classification Search
CPC .... F24C 15/325; F24C 15/2035; F24C 7/067; F24C 15/32; F24C 15/322; F24C 15/2042;

(Continued)

(56) References Cited

U.S. PATENT DOCUMENTS 5,945,024 A 8/1999 Fukunaga et al.
6,262,406 B1 7/2001 McKee et al.
(Continued)

FOREIGN PATENT DOCUMENTS

CA 2 512 912 A1 4/1995
CA 2 365 023 A1 7/2002
(Continued)

OTHER PUBLICATIONS

International Search Report dated Feb. 14, 2019; International Application #: PCT/KR2018/012357.
(Continued)

*Primary Examiner* — Shawntina T Fuqua
(74) *Attorney, Agent, or Firm* — Jefferson IP Law, LLP

(57) ABSTRACT

An oven with an enhanced structure to improve cooking performance is provided. The oven includes a main body, a cooking chamber arranged inside the main body, the cooking chamber including an open front, a door arranged to open or close the front of the cooking chamber, a circulation fan arranged to circulate air in the cooking chamber, a suction port formed on a wall of the cooking chamber facing the circulation fan, a turn table arranged on a bottom plate of the cooking chamber, the turn table being rotatable around a rotating shaft, and a discharging port formed on the bottom plate of the cooking chamber, the discharging port for discharging air that has passed through the suction port into the cooking chamber, the discharging port being located under the turn table.

20 Claims, 22 Drawing Sheets

(58) Field of Classification Search
CPC ... F24C 15/20; F24C 15/2078; F24C 15/2092
See application file for complete search history.

(56) References Cited

U.S. PATENT DOCUMENTS

| | | | | |
|---|---|---|---|---|
| 2007/0090103 | A1 | 4/2007 | France et al. | |
| 2007/0295322 | A1 | 12/2007 | Dobie et al. | |
| 2017/0079473 | A1 | 3/2017 | Bigott | |
| 2018/0220498 | A1* | 8/2018 | Jeon | H05B 6/6473 |

FOREIGN PATENT DOCUMENTS

| | | | |
|---|---|---|---|
| JP | 2016-200393 | A | 12/2016 |
| KR | 20-1992-0001038 | U | 1/1992 |
| KR | 1998-017801 | U | 7/1998 |
| KR | 20-1998-0062344 | U | 11/1998 |
| KR | 10-0646879 | B1 | 11/2006 |
| KR | 10-0646881 | B1 | 11/2006 |
| KR | 10-2011-0051110 | A | 5/2011 |
| KR | 10-2016-0027748 | A | 3/2016 |
| KR | 10-2016-0027748 | A | 3/2016 |
| WO | 2015/118867 | A1 | 8/2015 |

OTHER PUBLICATIONS

European Search Report dated Sep. 22, 2020, issued in European Application No. 18870423.3.

* cited by examiner

OVEN

CROSS-REFERENCE TO RELATED APPLICATION(S)

This application is based on and claims priority under 35 U.S.C. § 119 of a Korean patent application number 10-2017-0139046, filed on Oct. 25, 2017, in the Korean Intellectual Property Office, the disclosure of which is incorporated by reference herein in its entirety.

BACKGROUND

1. Field

The disclosure relates to ovens. More particularly, the disclosure relates to an oven with an enhanced structure to improve cooking performance.

2. Description of Related Art

In general, ovens are devices equipped with a cooking chamber, a heating device for applying heat into the cooking chamber, and a circulation fan for circulating the heat produced by the heating device inside the cooking chamber to cook food.

The ovens may be classified into electric types, gas types, and microwave types. The electric oven uses an electric heater as a heat source, and the gas and microwave ovens use heat from gas and frictional heat of water molecules at high frequencies as heat sources, respectively.

A suction port and a discharging port may be formed on a sidewall of the cooking chamber. The cooking chamber may be heated by air circulation through the suction port and discharging port. While uniform heating in the cooking chamber may lead to satisfactory cooking results, non-uniform heating in the cooking chamber may lead to incorrect cooking results.

Where to install the suction port and discharging port may be an important factor in determining whether the cooking chamber may be heated uniformly.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an oven with an enhanced structure to be able to uniformly heat the cooking chamber.

Another aspect of the disclosure is to provide an oven with an enhanced structure to increase a flow rate of air circulating in the cooking chamber.

Additional aspects will be set forth in part in the description which follows and, in part, will be apparent from the description, or may be learned by practice of the presented embodiments.

In accordance with an aspect of the disclosure, an oven is provided. The oven may include a main body, a cooking chamber arranged inside the main body, the cooking chamber including an open front, a door arranged to open or close the front of the cooking chamber, a circulation fan arranged to circulate air in the cooking chamber, a suction port formed on a wall of the cooking chamber facing the circulation fan, a turn table arranged on a bottom plate of the cooking chamber, the turn table being rotatable around a rotating shaft, and a discharging port formed on the bottom plate of the cooking chamber, discharging port for discharging air that has passed through the suction port into the cooking chamber, the discharging port being located under the turn table.

The discharging port may be formed in a front portion of the bottom plate of the cooking chamber to be adjacent to the door.

The discharging port may be located inwards from edges of the turn table with respect to the rotating shaft of the turn table.

The oven may further include a suction duct arranged to communicate with the suction port, the suction duct accommodating the circulation fan therein, and a discharging duct coupled to an outside of the bottom plate of the cooking chamber, the discharging duct in communication with the discharging port and coupled to the suction duct.

The discharging duct may include a curved portion bulging toward the front of the cooking chamber.

At least a portion of the discharging duct may be enclosed by one or more heat insulating materials.

The bottom plate of the cooking chamber may include a first sector having the discharging port formed therein, and a second sector concavely formed therein. The oven may further include a dust collector provided to link the first sector and the second sector to guide foreign substances into the second sector.

The dust collector may include a depth less than the depth of the second sector.

The dust collector may include a first collector formed to enclose the first sector, and a second collector linking the first collector and the second sector.

The oven may further include a discharging port cover detachably coupled to the bottom plate of the cooking chamber to cover the discharging port.

The oven may further include a cutting portion formed on the bottom plate of the cooking chamber, and a strip detachably coupled to the bottom plate of the cooking chamber to define the bottom plate of the cooking chamber by covering the cutting portion, and including the discharging port formed thereon.

At least one of the cutting portion or the strip may be coupled with a sealing member.

In accordance with another aspect of the disclosure, an oven is provided. The oven includes a main body, a cooking chamber arranged inside the main body, the cooking chamber including an open front, a door arranged to open or close the front of the cooking chamber, a suction port formed on a first wall of the cooking chamber, a first discharging port formed on a second wall of the cooking chamber, a second discharging port formed on a third wall of the cooking chamber, and a circulation duct arranged between the main body and the cooking chamber, the circulation duct in communication with the cooking chamber.

The suction port may be located between the first discharging port and the second discharging port.

The circulation duct may include a suction duct in communication with the suction port, a first discharging duct coupled to an end of the suction duct, the first discharging duct in communication with the first discharging port, and a second discharging duct coupled to the other end of the suction duct, the second discharging duct in communication with the second discharging port.

The oven may further include a third discharging port formed on a fourth wall of the cooking chamber.

At least one of the first discharging duct or the second discharging duct is in communication with the third discharging port.

The third discharging port may be formed to face the suction port.

At least a portion of the circulation duct may be enclosed by one or more heat insulating materials.

In accordance with another aspect of the disclosure, an oven is provided. The oven may include a main body, a cooking chamber arranged inside the main body, the cooking chamber including an open front, a door arranged to open or close the front of the cooking chamber, a suction port formed on a side wall of the cooking chamber, a first discharging port formed on a top wall of the cooking chamber, a second discharging port formed on a bottom plate of the cooking chamber, a circulation duct in communication with the suction port, the first discharging port, and the second discharging port, and at least one flow-rate regulating device arranged in the circulation duct to regulate an amount of air discharged into the cooking chamber through at least one of the first discharging port or the second discharging port.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following with description taken in conjunction with the accompanying drawings, in which.

Throughout the drawings, it should be noted that like reference numbers are used to depict the same or similar elements, features, and structures.

DETAILED DESCRIPTION

Figure 1:
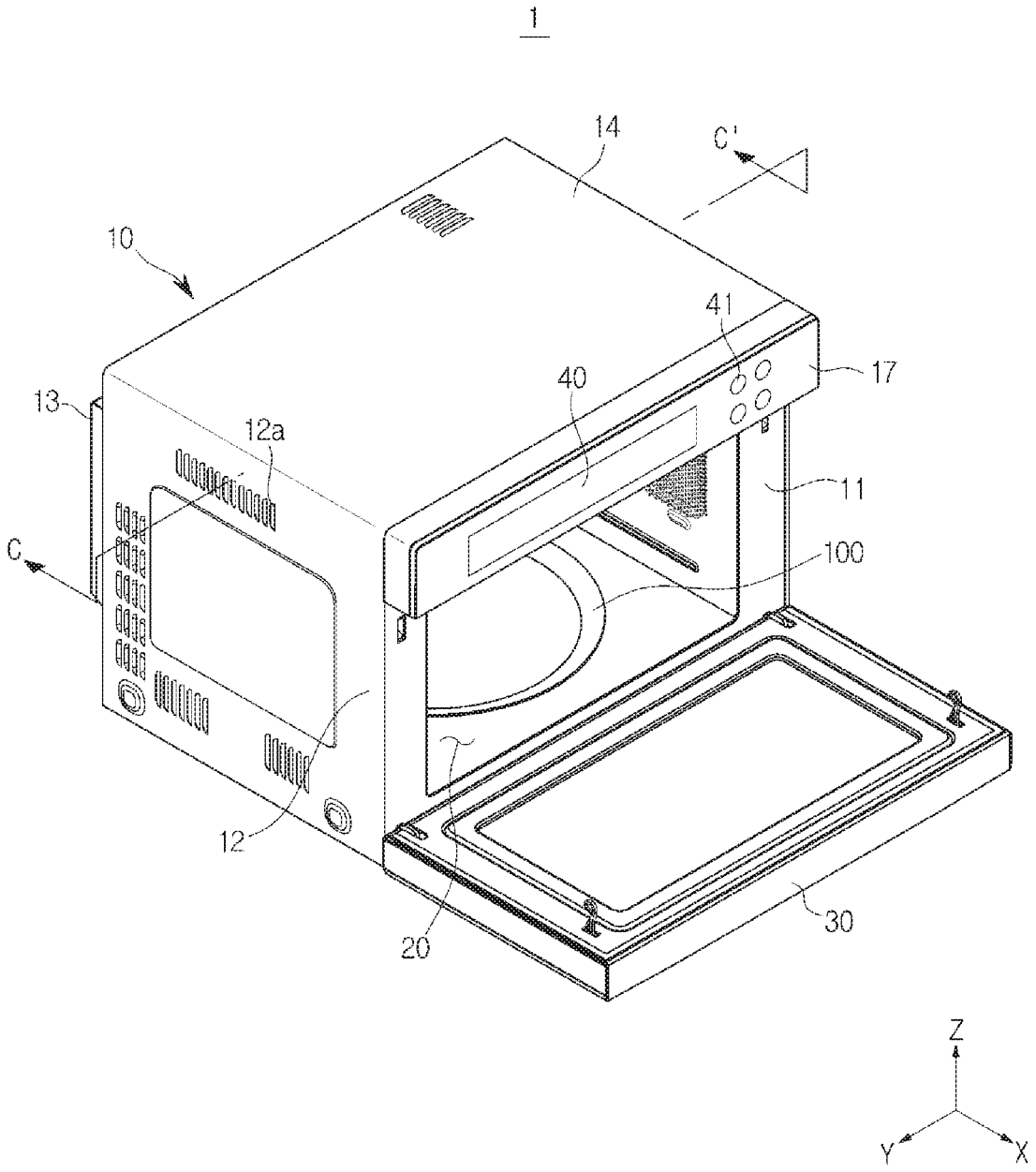
FIG. 1 is a perspective view of an oven, according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Reference will now be made in detail to embodiments, examples of which are illustrated in the accompanying drawings, wherein like reference numerals refer to the like elements throughout. The terms "front", "rear", "upper", "lower", "top", and "bottom" as herein used are defined with respect to the drawings, but the terms may not restrict the shape and position of the respective components.

Hereinafter, the front-and-back direction of a cooking chamber 20 is represented by 'X', the left-and-right direction of the cooking chamber 20 is represented by 'Y', and the up-and-down (or vertical) direction of the cooking chamber 20 is represented by 'Z'. The vertical direction of the cooking chamber 20 may also be used to refer to the same direction as the direction of rotating shaft.

FIG. 1 is a perspective view of an oven, according to an embodiment of the disclosure.

Figure 2:
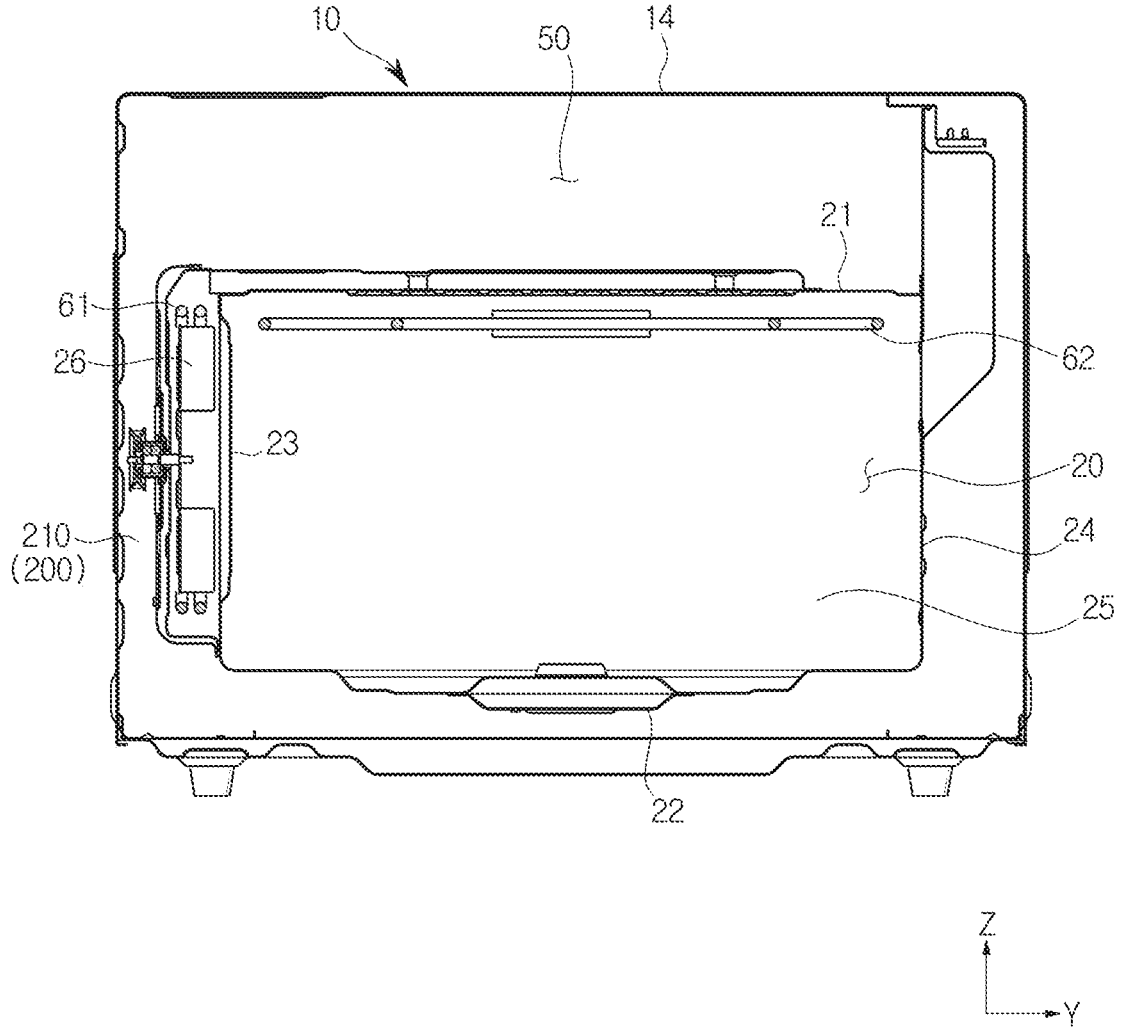
FIG. 2 is a cross-sectional view of the oven of FIG. 1 cut along the line C-C', according to an embodiment of the disclosure.

FIG. 2 is a cross-sectional view of the oven of FIG. 1 cut along the line C-C'. FIGS. 1 and 2 focus on an oven 1 employing the cooking chamber 20 according to an embodiment of the disclosure.

Referring to FIGS. 1 and 2, the oven 1 may include a main body 10 forming the exterior.

The main body 10 may include a front panel 11 forming the front face of the main body 10, side panels 12 forming the side faces of the main body 10, a rear panel 13 forming the rear face of the main body 10, and a top panel 14 forming the top face of the main body 10.

In an upper front portion of the front panel 11, an electric chamber cover 17 may be provided to cover the front of an electric chamber 50. The electric chamber cover 17 may be equipped with a display module 40.

The side panels 12 may have a suction part 12*a* (e.g., one or more inlets) to allow air to be drawn into the electric chamber 50. The outside air drawn into the electric chamber 50 through the suction part 12*a* may cool down electric parts while moving around inside the electric chamber 50.

The oven 1 may further include the cooking chamber 20 arranged inside the main body 10 to have open front. For example, the cooking chamber 20 may have the form of an open front box. An object to be cooked may be put into or pulled out of the cooking chamber 20 through the open front.

The cooking chamber 20 may include a top wall 21 defining the top face of the cooking chamber 20, a bottom wall 22 defining the bottom face of the cooking chamber 20, a left side wall 23 defining the left face of the cooking chamber 20 (see FIG. 3), a right side wall 24 (see FIG. 3) defining the right face of the cooking chamber 20, and a rear wall 25 defining the rear face of the cooking chamber 20. Hereinafter, the bottom wall 22 of the cooking chamber 20 may also be referred to as a "bottom plate" of the cooking chamber 20.

Both of the side walls 23 and 24 of the cooking chamber 20 may be provided with a plurality of supporters or supports (not shown). Racks (not shown) may be mounted on the plurality of supporters to put an object to be cooked thereon.

A divider (not shown) may be detachably mounted on the plurality of supporters to divide the cooking chamber 20 into multiple sections. The multiple cooking sections obtained by dividing the cooking chamber 20 may not be necessarily equal but may be different in size. The divider may be formed of an insulating material to insulate the multiple cooking sections.

The oven 1 may further include a door 30 to open or close the cooking chamber 20. Specifically, the door 30 may be pivotally provided to open or close the front of the cooking chamber 20. The door 30 may be pivotally installed on the main body 10. A door handle (not shown) may be mounted on the door 30. Specifically, the door handle may be provided in an upper front portion of the door 30 for the user to grip the handle and easily open or close the cooking chamber 20.

The oven 1 may further include a display module 40 provided to display various operation information of the oven 1 and to allow the user to enter operation commands. The display module 40 may be mounted on the electric chamber cover 17 arranged in the upper front portion of the front panel 11. The electric chamber cover 17 may be further equipped with a manipulation part 41 for the user to enter operation commands, which is provided separately from the display module 40.

The oven 1 may further include the electric chamber 50 provided to accommodate electric parts. The electric parts as herein used may be used as general terms of parts that control operation of various accessories including the display module 40. The electric chamber 50 may be arranged on top of the cooking chamber 20. There may be heat insulating materials arranged between the electric chamber 50 and the cooking chamber 20 to insulate the electric chamber 50 and the cooking chamber 20. The heat insulating materials may be arranged to cover not only the space between the electric chamber 50 and the cooking chamber 20 but also the entire cooking chamber 20 in order to insulate the cooking chamber 20 from the outside of the oven 1.

The oven 1 may further include a cooler provided to cool down the electric chamber 50. The temperature inside the electric chamber 50 may rise due to emission of heat from the various electric parts. The cooler may serve to cool down the electric chamber 50 by circulating air throughout the electric chamber 50. The cooler may include an electric chamber cooling fan (not shown) provided to circulate air, and an exhaust duct (not shown) having an exhaust fluid path formed therein. Air brought in by the electric chamber cooling fan may move along the exhaust fluid path and may be discharged forward from the oven 1.

The oven 1 may further include a heater arranged to heat the air circulating inside the cooking chamber 20.

The heater may include a first heater 61 arranged outside the cooking chamber 20. The first heater 61 may be installed on one wall of the cooking chamber 20 to be located outside the cooking chamber 20. For example, the first heater 61 may be installed on the left wall 23 or the right wall 24 to be located outside the cooking chamber 20.

Figure 3:
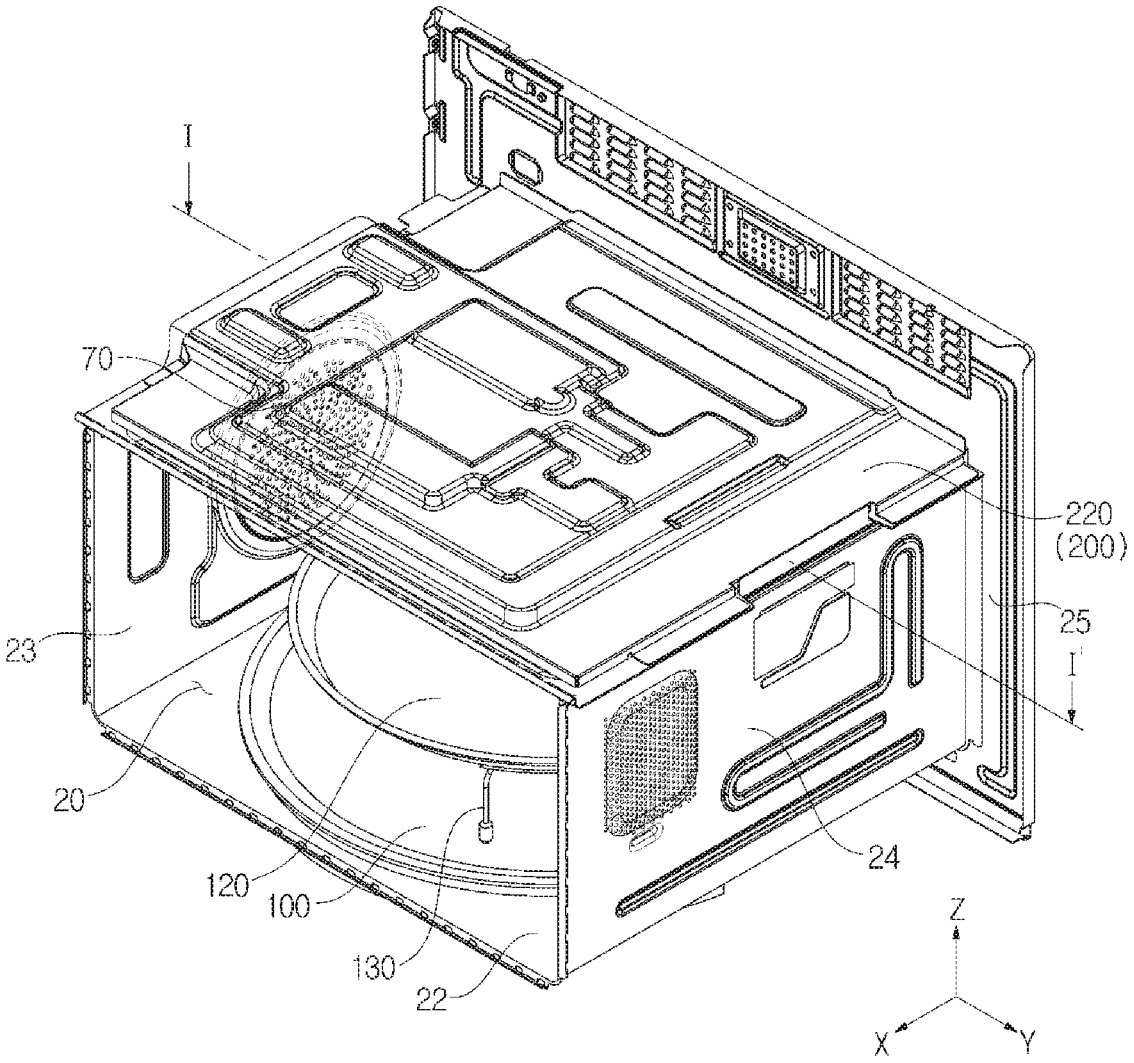
FIG. 3 is a perspective view of a cooking chamber of an oven, according to an embodiment of the disclosure.

Explaining this from a different perspective, the first heater 61 may be arranged to face a suction port 70 (see FIG. 3). Specifically, the first heater 61 may be installed on one wall of the cooking chamber 70, on which the suction port 70 is formed, to heat the air that has passed through the suction port 70. The first heater 61 may be arranged to be adjacent to the suction port 70 to primarily heat the air brought in through the suction port 70.

For example, the first heater 61 may include a convection heater.

The heater may further include a second heater 62 installed inside the cooking chamber 20. The second heater 62 may be arranged at a certain distance from the first heater 61. Specifically, the second heater 62 may be installed on the rear wall 25 of the cooking chamber 20 to be adjacent to the top wall 21 of the cooking chamber 20.

Figure 4:
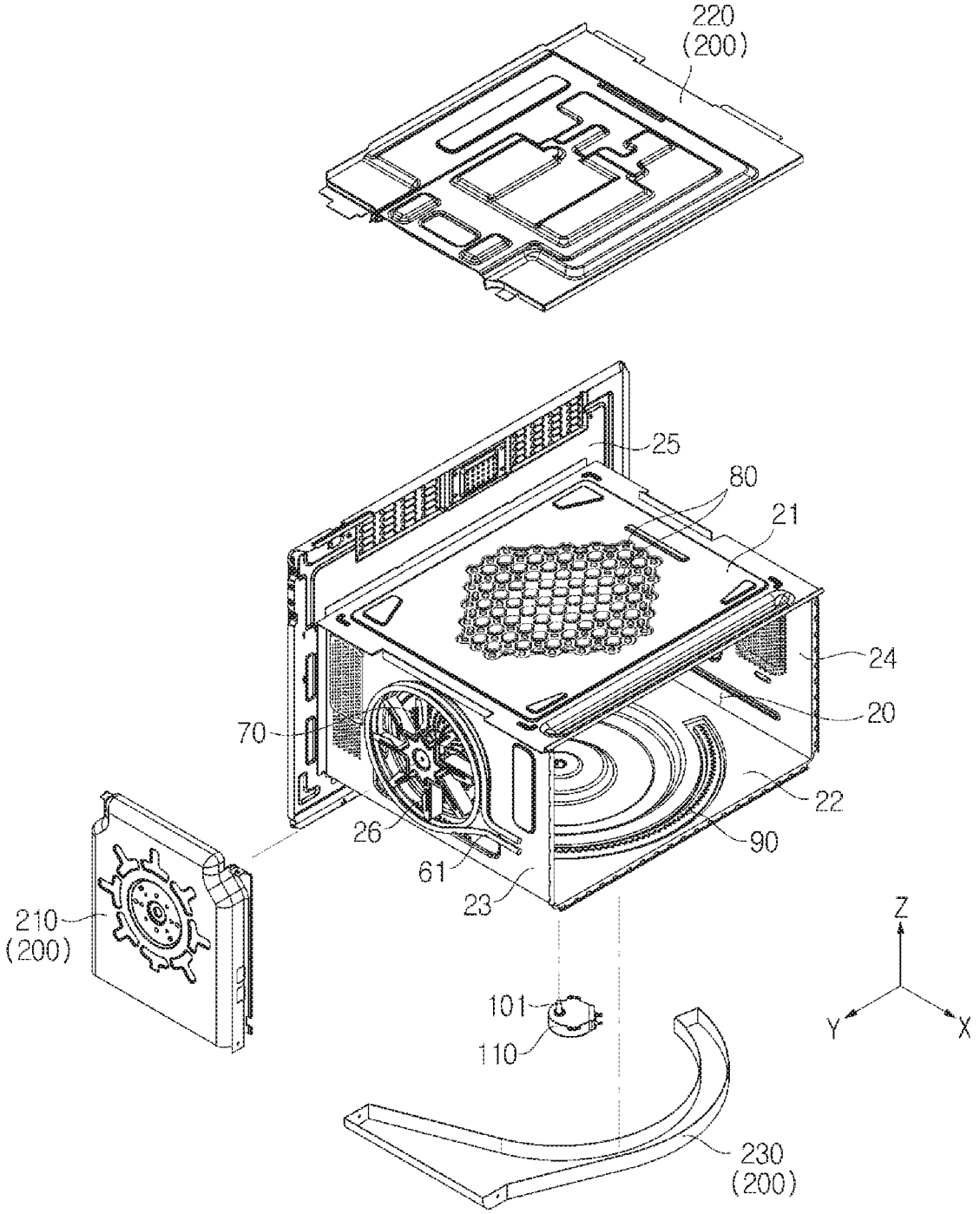
FIG. 4 is an exploded perspective view of the cooking chamber of FIG. 3 of an oven, according to an embodiment of the disclosure.

Explaining this from a different perspective, the second heater 62 may be arranged to face a first discharging port 80 (see FIG. 4). Specifically, the second heater 62 may be installed inside the cooking chamber 20 to face the first discharging port 80. The second heater 62 may be arranged to secondarily heat the air that has passed through the suction port 70. In other words, the second heater 62 may be arranged to be adjacent to the first discharging port 80 to heat the air brought in through the suction port 70 and the first discharging port 80 in sequence.

The second heater 62 may be an electric heater having an electric resistor. However, the second heater 62 is not limited to being an electric heater, but may, for example, be a gas heater that produces heat by burning gas. For example, the second heater 62 may include a grill heater.

The oven 1 may further include a circulation fan 26 (see FIG. 4) arranged to circulate air. The circulation fan 26 may be arranged outside the cooking chamber 20 to circulate the air inside the cooking chamber 20. The circulation fan 26 may be installed on one wall of the cooking chamber 20 to be located outside the cooking chamber 20. For example, the circulation fan 26 may be installed on the left wall 23 or the right wall 24 to be adjacent to the first heater 61.

Explaining this from a different perspective, the circulation fan 26 may be arranged to face the suction port 70. Specifically, the circulation fan 26 may be installed on one wall of the cooking chamber 70, on which the suction port 70 is formed, to draw in the air inside the cooking chamber 20 through the suction port 70. The circulation fan 26 may be installed with the first heater 61 on the one wall, on which the suction port 70 is formed.

For example, the circulation fan 26 may include a convection fan.

The oven 1 may further include a circulation motor (not shown) provided to drive the circulation fan 26.

The oven 1 may further include the suction port 70 formed on one wall of the cooking chamber 20. Specifically, the oven 1 may further include a plurality of suction ports 70 formed on one wall of the cooking chamber 20. The suction port 70 may have a circular form. The form of the suction port 70 is not, however, limited thereto, but may be variously changed.

The oven 1 may further include at least one discharging port 80, 90 formed on other walls of the cooking chamber 20 than a wall having the suction port 70 formed thereon, to discharge the air that has passed through the suction port 70 into the cooking chamber 20 (see FIG. 4). The at least one discharging port 80, 90 will be described in more detail later.

FIG. 3 is a perspective view of a cooking chamber of an oven, according to an embodiment of the disclosure.

FIG. 4 is an exploded perspective view of the cooking chamber of FIG. 3, according to an embodiment of the disclosure.

Figure 5:
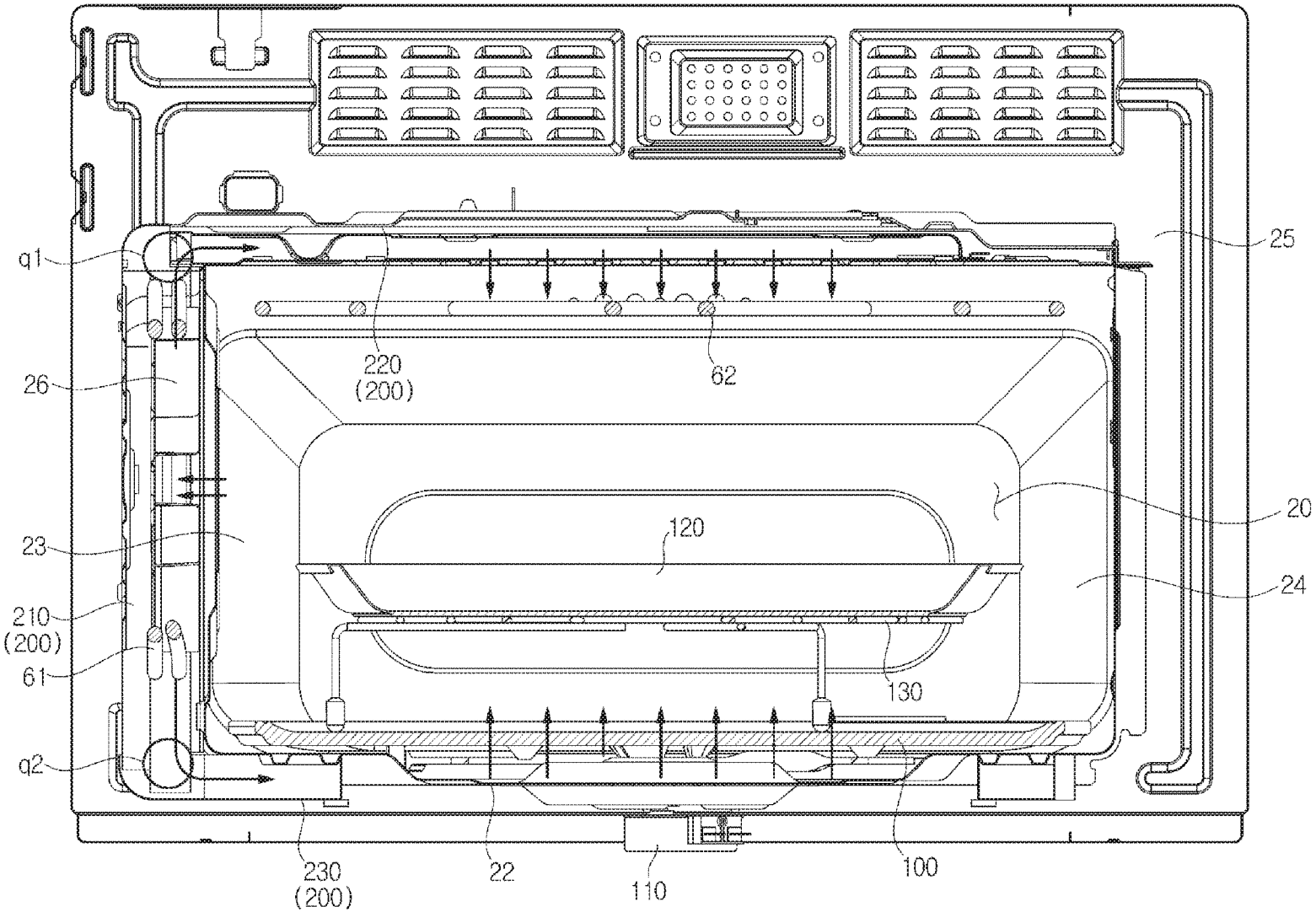
FIG. 5 is a cross-sectional view of the cooking chamber of FIG. 3 cut along the line I-I', according to an embodiment of the disclosure.

FIG. 5 is a cross-sectional view of the cooking chamber of FIG. 3 cut along the line I-I', according to an embodiment of the disclosure.

Referring to FIGS. 3 to 5, the oven 1 may further include a turn table 100 rotationally arranged inside the cooking chamber 20. The turn table 100 may be arranged on the bottom plate 22 of the cooking chamber 20 to be rotatable around a rotating shaft 101.

The oven 1 may further include a turn table motor 110 for generating driving power to rotate the turn table 100. The turn table 100 may be coupled to the turn table motor 110 to receive the driving power from the turn table motor 110. The turn table motor 110 may include the rotating shaft 101 extending in the vertical direction Z of the cooking chamber 20. The turn table motor 110 may be arranged outside the cooking chamber 20. For example, the turn table motor 110 may be arranged between the cooking chamber 20 and the main body 10. Specifically, the turn table motor 110 may be arranged between the bottom plate 22 of the cooking chamber 20 and the main body 10.

The oven 1 may further include a tray 120 provided to put an object to be cooked thereon. The tray 120 may be arranged inside the cooking chamber 20 and rotated along with the turn table 100.

The oven 1 may further include a supporting rack 130 to support the tray 120. The supporting rack 130 may be made of wire to have certain height in the vertical direction Z of the cooking chamber 20. The tray 120 may be arranged on the turn table 100 with the support of the supporting rack 130. That is, the tray 120 may be put on the supporting rack 130. The supporting rack 130 may be rotated along with the turn table 100. The tray 120 may be put directly on the turn table 100 or indirectly on the turn table 100 by being laid on the supporting rack 130.

The oven 1 may further include the suction port 70 formed on one wall of the cooking chamber 20 facing the circulation fan 26. In other words, the suction port 70 may be formed on one wall of the cooking chamber 20, on which the circulation fan 26 is installed. For example, the suction port 70 may be formed on the left wall 23 of the cooking chamber 20.

The oven 1 may further include at least one discharging port 80, 90 formed at a certain distance from the suction port 70 such that the air that has passed through the suction port 70 may be discharged into the cooking chamber 20.

Of the at least one discharging port 80, 90, there may be a first discharging port 80 formed on a wall of the cooking chamber 20, which is different from a wall of the cooking chamber 20 having the suction port 70 formed thereon. The first discharging port 80 may be formed on a neighboring wall of the cooking chamber 20 to a wall of the cooking chamber 20 having the suction port 70 formed thereon. For example, the first discharging port 80 may be formed on the top wall 21 of the cooking chamber 20. The first discharging port 80 may be formed to face the second heater 62. Accordingly, the air that has been discharged into the cooking chamber 20 through the first discharging port 80 may be heated by the second heater 62. The first discharging port 80 may have a polygonal form. The form of the first discharging port 80 is not, however, limited thereto, but may be variously changed. The first discharging port 80 may be formed in the plural.

Of the at least one discharging port 80, 90, there may be a second discharging port 90 formed on a different wall of the cooking chamber 20 from the walls having the suction port 70 and the first discharging port 80 formed thereon. For example, when the suction port 70 and the first discharging port 80 are formed on the first and second walls of the cooking chamber 20, respectively, the second discharging port 90 may be formed on the third wall of the cooking chamber 20, which is different from the first and second walls. The second discharging port 90 may be formed on a neighboring wall of the cooking chamber 20 to a wall of the cooking chamber 20 having the suction port 70 formed thereon. The second discharging port 90 may be formed on a wall of the cooking chamber 20 opposite to a wall of the cooking chamber 20 having the first discharging port 80 formed thereon. The suction port 70 may be located between the first discharging port 80 and the second discharging port 90. For example, the second discharging port 90 may be formed on the bottom plate 22 of the cooking chamber 20. The second discharging port 90 may be formed to be opposite to the turn table 100. Specifically, the second discharging port 90 may be formed to face the base of the turn table 100. The second discharging port 90 may have a circular form. The form of the first discharging port 90 is not, however, limited thereto, but may be variously changed. The second discharging port 90 may be formed in the plural.

The second discharging port 90 may be formed on the bottom plate 22 of the cooking chamber 20 to be adjacent to the front of the cooking chamber 20. The second discharging port 90 may be formed on the bottom plate 22 of the cooking chamber 30 to be adjacent to the door 30. Specifically, the second discharging port 90 may be formed near the front end of the bottom plate 22 of the cooking chamber 30 to be adjacent to the door 30.

As such, the second discharging port 90 formed on the bottom plate 22 of the cooking chamber 20 may facilitate uniform heating of the cooking chamber 20. In the conventional oven, the upper portion of the cooking chamber 20 may have higher temperatures than the lower portion of the cooking chamber 20 due to the influence of the second heater 62. If the cooking chamber 20 is not uniformly heated, satisfactory cooking results should not be expected. For example, if the cooking chamber 20 is not uniformly heated, baking performance of the oven on an object to be cooked, such as sponge cake, pizza, etc., may decline significantly. By contrast, as in the embodiment of the disclosure, with the second discharging port 90 formed on the bottom plate 22 of the cooking chamber 20, the lower portion of the cooking chamber 20 may also be sufficiently heated by the heated air discharged through the second discharging port 90.

In addition, the second discharging port 90 formed on the bottom plate 22 of the cooking chamber 20 may facilitate elimination of moisture formed on the door 30. If there is a significant difference in temperature between the inside and the outside of the cooking chamber 20, moisture might be formed on the door 30. The moisture may be easily eliminated by the air discharged from the second discharging port 90.

The oven 1 may further include a circulation duct 200 through which the inside air of the cooking chamber 20 moves around. The circulation duct 200 may be arranged between the main body 10 and the cooking chamber 20 to communicate with the cooking chamber 20. The circulation duct 200 may be arranged outside the cooking chamber 20 to communicate with the cooking chamber 20.

The circulation duct 200 may include a suction duct 210 provided to communicate with the suction port 70. The suction duct 210 may be coupled to one wall of the cooking chamber 20 with the suction port 70 formed thereon. The suction duct 210 may accommodate the circulation fan 26 and the first heater 61. For example, the suction duct 210 may be coupled to the left wall 23 or the right wall 24 of the cooking chamber 20.

The circulation duct 200 may further include a first discharging duct 220 provided to communicate with the first discharging port 80. The first discharging duct 220 may be coupled to an end of the suction duct 210. Specifically, the first discharging duct 220 may be coupled to the upper end of the suction duct 210 to be located on the top wall 21 of the cooking chamber 20. For example, the first discharging duct 220 may be coupled to the top wall 21 of the cooking chamber 20.

The circulation duct 200 may further include a second discharging duct 230 provided to communicate with the second discharging port 90. The second discharging duct 230 may be coupled to the other end of the suction duct 210. Specifically, the second discharging duct 230 may be coupled to the lower end of the suction duct 210 to be located on the bottom plate 22 of the cooking chamber 20. For example, the second discharging duct 230 may be coupled to the bottom plate 22 of the cooking chamber 20.

Referring to FIG. 5, as the circulation fan 26 operates, the air inside the cooking chamber 20 moves into the suction duct 210 through the suction port 70. The air moving into the suction duct 210 becomes high temperature air by exchanging heat with the first heater 61. Some of the high temperature air is moved into the first discharging duct 220 and discharged into the cooking chamber 20 through the first discharging port 80. The rest of the high temperature air is moved into the second discharging duct 230 and discharged into the cooking chamber 20 through the second discharging port 90. The object to be cooked may be heated by exchanging heat with the high temperature air discharged into the cooking chamber 20. The high temperature air that has been discharged into the cooking chamber 20 through the first discharging port 80 may further be heated by the optional second heater 62.

The oven 1 may further include at least one flow-rate regulating device arranged in the circulation duct 200 to regulate an amount of air discharged into the cooking chamber 20 through at least one of the first and second discharging ports 80 and 90. In FIG. 5, 'q1' and 'q2' indicate where to install the at least one flow-rate regulating device. The at least one flow-rate regulating device will be described in more detail below with reference to FIGS. 19 to 21.

Figure 6:
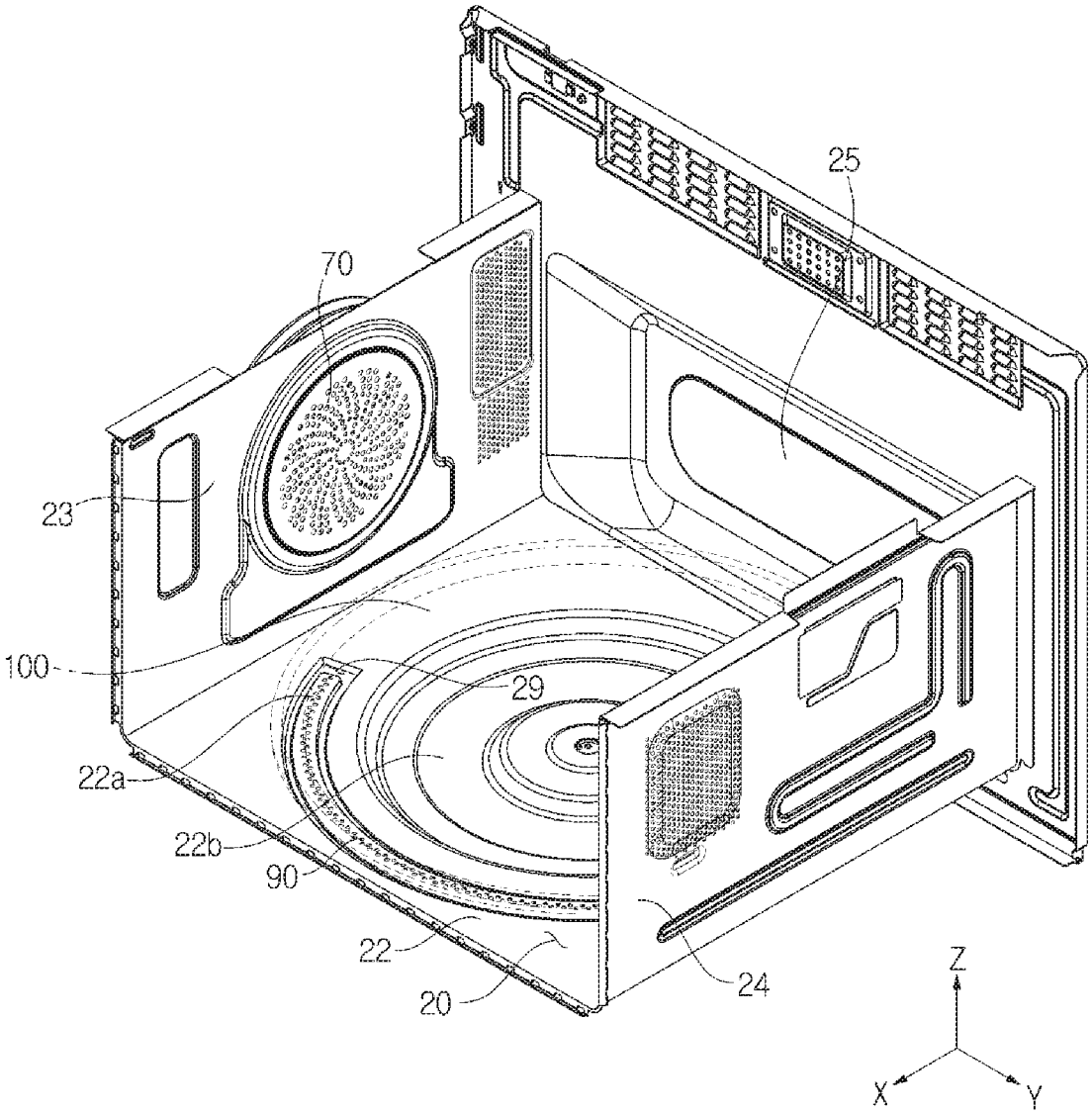
FIG. 6 shows a relation between a turn table and a discharging hole in the cooking chamber of FIG. 3, according to an embodiment of the disclosure.

FIG. 6 shows a relation between a turn table and a discharging hole in the cooking chamber of FIG. 3, according to an embodiment of the disclosure.

Referring to FIG. 6, the bottom plate 22 of the cooking chamber 20 may include a first sector 22*a* where the second discharging port 90 is formed. The first sector 22*a* may be adjacent to the front of the cooking chamber 20. In other words, the first sector 22*a* may be adjacent to the door 30.

The bottom plate 22 of the cooking chamber 20 may further include a second sector 22*b*, which is concavely formed. The second sector 22*b* may be located in the center portion of the bottom plate 22 of the cooking chamber 20. The second sector 22*b* may be located behind the first sector 22*a*. The second sector 22*b* may be located at a certain distance from the first sector 22*a*.

The oven 1 may further include a dust collector 29 formed on the bottom plate 22 of the cooking chamber 20 to collect foreign substances. The dust collector 29 may be concavely formed on the bottom plate 22 of the cooking chamber 30 to have a certain depth. The dust collector 29 may be formed along the edge of the first sector 22*a* where the second discharging port 90 is formed, in order to prevent foreign substances coming out of the object being cooked from moving into the second discharging port 90. The dust collector 29 may be separated from the second sector 22*b* by a certain distance.

The second discharging port 90 may be located inwards from the edge of the turn table 100 with respect to the rotating shaft 101 of the turn table 100. In other words, the second discharging port 90 may be concavely formed on the bottom plate 22 of the cooking chamber 100 to be hidden and not exposed by the turn table 100. For example, when the turn table 100 is circular around the rotating shaft 101, the second discharging port 90 may be located inwards from the edge of the turn table 100 in the radial direction of the turn table 100.

The reason of forming the second discharging port 90 to be located inwards from the edge of the turn table 100 with respect to the rotating shaft 101 of the turn table 100 is that foreign substances, such as oil, water, wastes coming out of the object being cooked are prevented from moving into the second discharging port 90.

In other words, by forming the second discharging port 90 to be located inwards from the edge of the turn table 100 with respect to the rotating shaft 101 of the turn table 100, the foreign substances may be primarily prevented from moving into the second discharging port 90. Furthermore, with the dust collector 29 formed on the bottom plate 22 of the cooking chamber 20, the foreign substances moving in between the bottom plate 22 and turn table 100 may be secondarily prevented from moving into the second discharging port 90.

Figure 7:
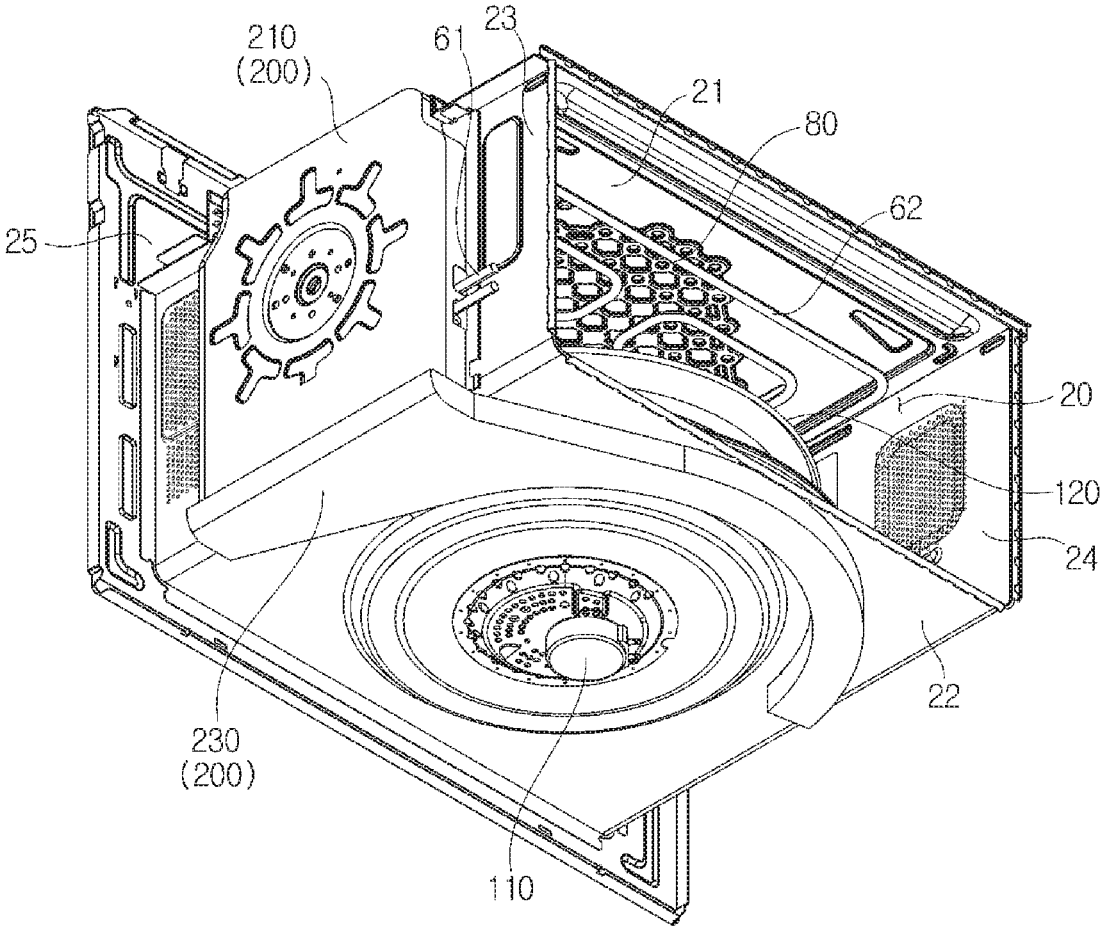
FIG. 7 is a bottom perspective view of the cooking chamber of FIG. 3 of an oven, according to an embodiment of the disclosure.

FIG. 7 is a bottom perspective view of the cooking chamber of FIG. 3 of an oven, according to an embodiment of the disclosure.

Referring to FIG. 7, the second discharging duct 230 may be coupled onto the bottom plate 22 of the cooking chamber 20 to be located between the cooking chamber 20 and the main body 10.

The second discharging duct 230 may be arranged on the bottom plate 22 of the cooking chamber 110 not to interfere with the turn table motor 110. In other words, the second discharging duct 230 may be arranged on the bottom plate 22 of the cooking chamber 4 not to block an opening (see FIG. 4) formed on the bottom plate 22. For example, the opening 28 may be formed in the second sector 22*b* of the bottom plate 22 of the cooking chamber 20. The air discharged from the first discharging port 80 and then discharged out of the cooking chamber 20 through the opening 28 of the cooking chamber 20 prevents the turn table motor 110 from being overheated. Accordingly, the second discharging duct 230 may be arranged on the bottom plate 22 of the cooking chamber 110 not to interfere with the turn table motor 110 and the opening 28 of the cooking chamber 20.

The second discharging duct 230 may include a curved portion. Specifically, the second discharging duct 230 may include a curved portion bulging toward the front of the cooking chamber 20.

Figure 8:
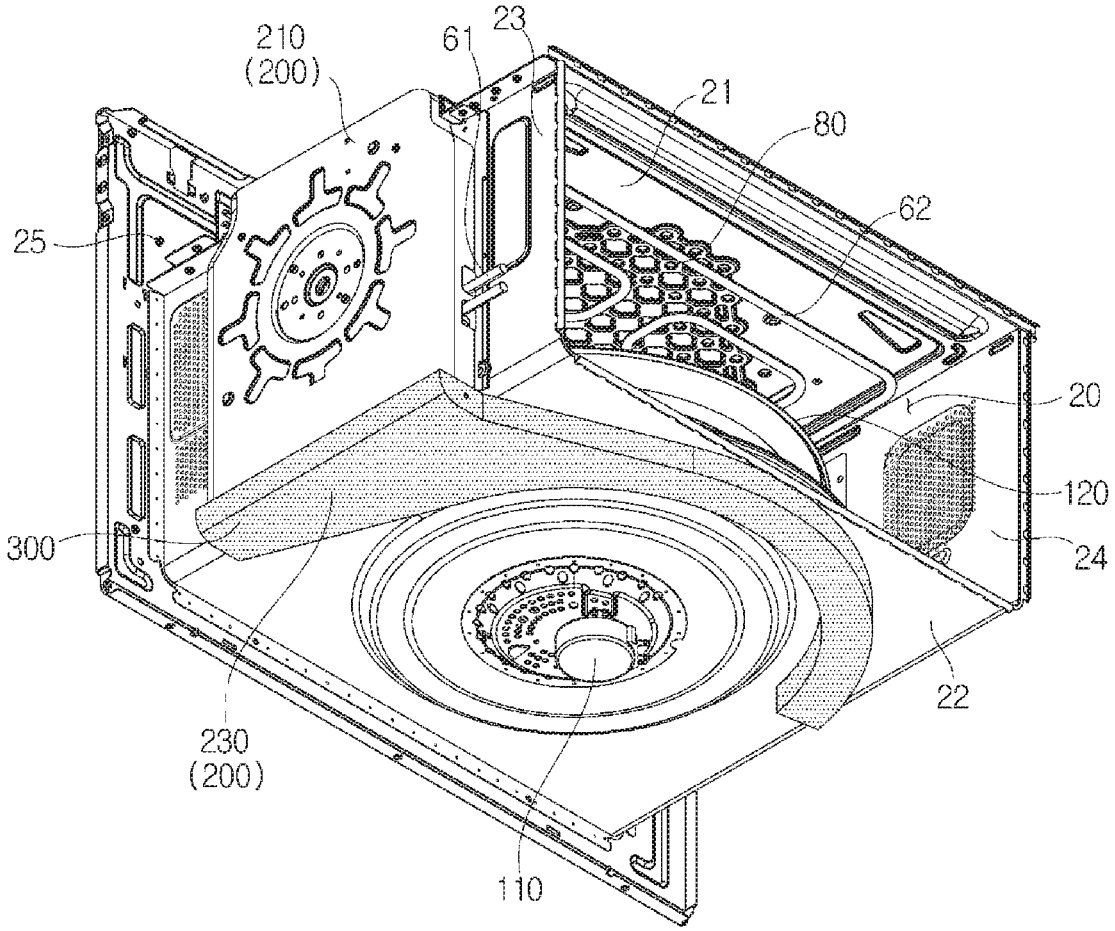
FIG. 8 is a bottom perspective view of another cooking chamber of an oven, according to an embodiment of the disclosure.

FIG. 8 is a bottom perspective view of another cooking chamber of an oven, according to an embodiment of the disclosure. Descriptions overlapping with what are described with reference to FIGS. 1 to 7 will not be repeated.

Referring to FIG. 8, the oven 1 may further include one or more heat insulating materials 300 provided to enclose at least a portion of the circulation duct 200. For example, at least a portion of the second discharging duct 230 may be covered with the heat insulating materials 300. The heat insulating materials 300 may cover the outer surface of the second discharging duct 230. The heat insulating materials 300 may include urethane foam. The heat insulating materials 300 intercepts heat exchange between the inside air and the outside air of the second discharging duct 230 and prevents an increase of the temperature of the turn table motor 110 due to the heated air inside the second discharging duct 230.

Figure 9:
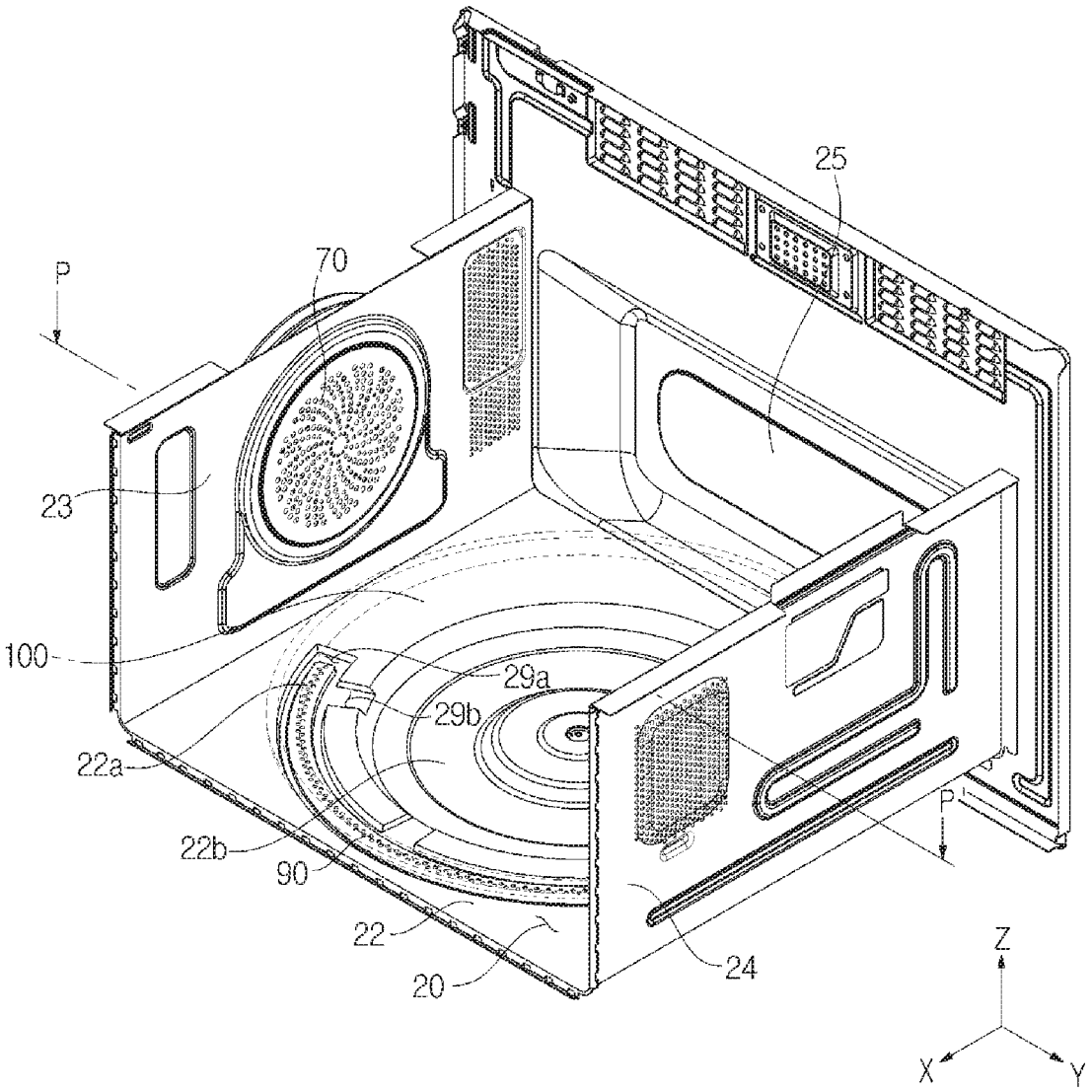
FIG. 9 shows another cooking chamber of an oven, according to an embodiment of the disclosure.

FIG. 9 shows another cooking chamber of an oven, according to an embodiment of the disclosure.

Figure 10:
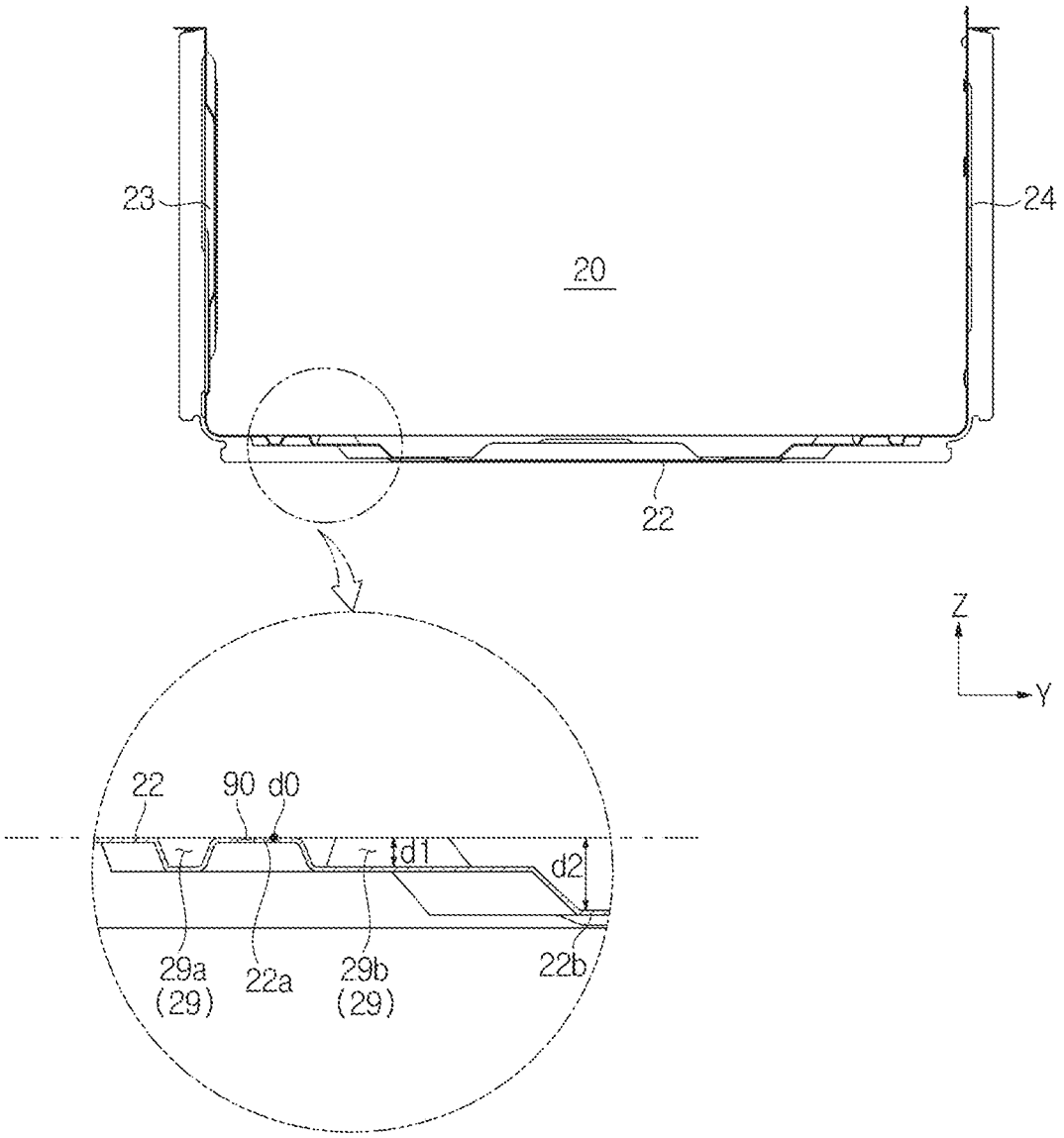
FIG. 10 is a cross-sectional view of the cooking chamber of FIG. 9 cut along the line P-P', according to an embodiment of the disclosure.

FIG. 10 is a cross-sectional view of the cooking chamber of FIG. 9 cut along the line P-P', according to an embodiment of the disclosure. Descriptions overlapping with what are described with reference to FIGS. 1 to 7 will not be repeated.

Referring to FIGS. 9 and 10, the oven 1 may further include the dust collector 29 formed on the bottom plate 22 of the cooking chamber 20 to collect foreign substances. The dust collector 29 may be concavely formed on the bottom plate 22 of the cooking chamber 30 to have a certain depth.

The dust collector 29 may link the first sector 22*a* and the second sector 22*b* to guide foreign substances coming out of the object being cooked to the second sector 22*b* of the bottom plate 22 of the cooking chamber 20.

The dust collector 29, the first sector 22*a*, and the second sector 22*b* may have different depths. The depth of the dust collector 29, the first sector 22*a*, and the second sector 22*b* may be measured from the base of the cooking chamber 20. The depth d1 of the dust collector 29 may be defined as a distance from the base of the cooking chamber 20 to the bottom of the dust collector 29. The depth d0 of the first sector 22*a* may be defined as a distance from the base of the cooking chamber 20 to the bottom of the first sector 22*a*. The depth d2 of the second sector 22*a* may be defined as a distance from the base of the cooking chamber 20 to the bottom of the second sector 22*b*. The dust collector 29 may be deeper than the first sector 22*a* with the second discharging port 90 formed therein, to prevent foreign substances coming out of the object being cooked from moving into the second discharging port 90. That is, the depth d1 of the dust collector 29 may be deeper than the depth d0 of the first sector 22*a*. In this case, the first sector 22*a* may be coplanar with the bottom plate 22 of the cooking chamber 20. The depth d0 of the first sector 22*a* may be '0' deep from the bottom plate 22 of the cooking chamber 20. The dust collector 29 may be shallower than the second sector 22*b*. That is, the depth d1 of the dust collector 29 may be less than the depth d2 of the second sector 22*b*. Accordingly, the foreign substances accommodated in the dust collector 29 may be readily guided into the second sector 22*b*.

The dust collector 29 may include a first collector 29*a* formed to enclose the first sector 22*a*. Specifically, the first collector 29*a* may be concavely formed on the bottom plate 22 of the cooking chamber 20 along the edges of the first sector 22*a*.

The dust collector 29 may further include a second collector 29*b* linking the first collector 29*a* and the second sector 22*b*. The dust collector 29 may include at least one second collector 29*b*. The at least one second collector 29*b* may be concavely formed on the bottom plate 22 of the cooking chamber 20 to be separated from each other along the edges of the first collector 29*a*.

Figure 11:
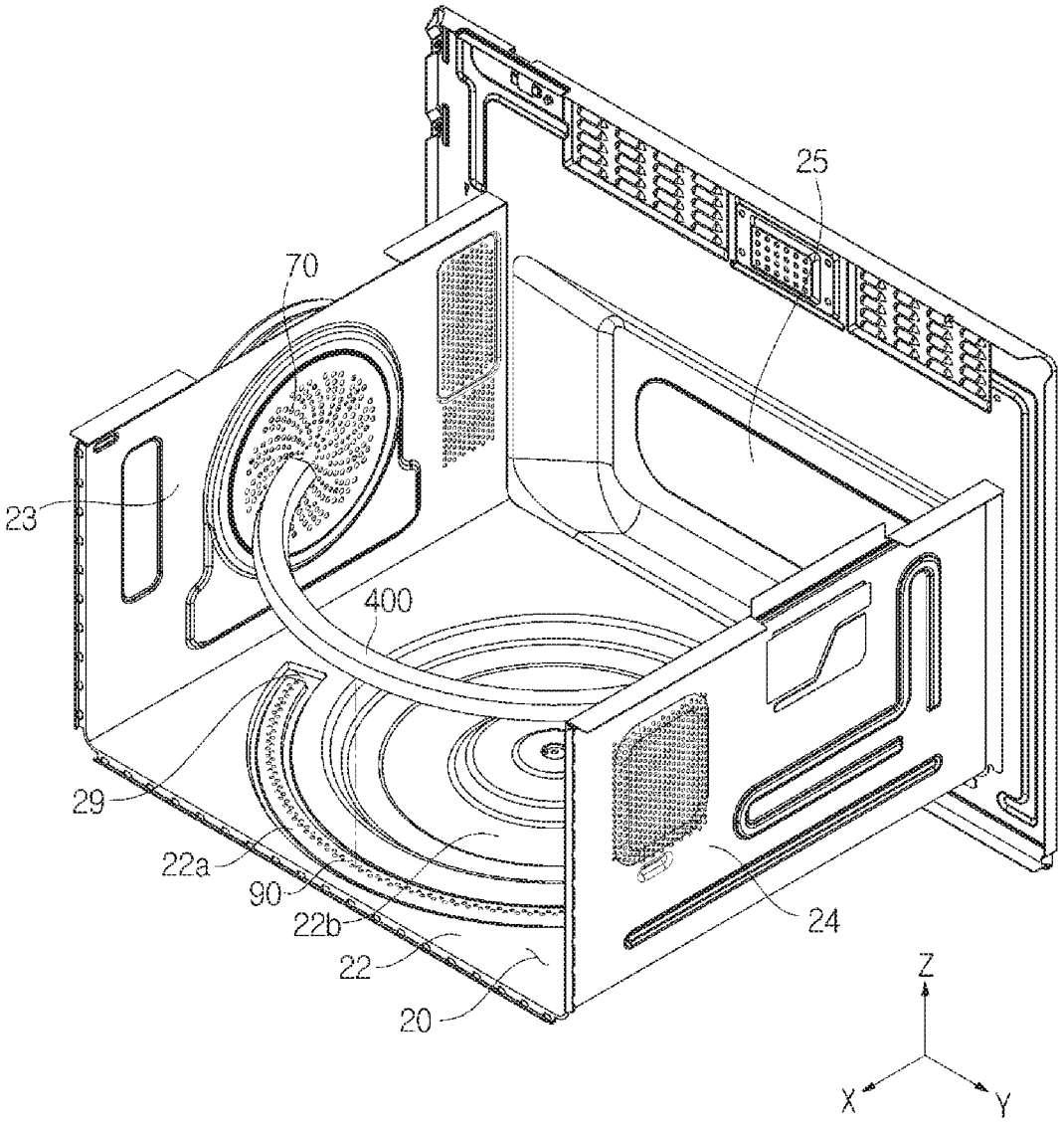
FIG. 11 shows another cooking chamber of an oven, according to an embodiment of the disclosure.

FIG. 11 shows another cooking chamber of an oven, according to an embodiment of the disclosure. Descriptions overlapping with what are described with reference to FIGS. 1 to 7 will not be repeated.

Referring to FIG. 11, the oven 1 may further include a discharging port cover 400 detachably coupled to the bottom plate 22 of the cooking chamber 20. Specifically, the discharging port cover 400 may be detachably coupled to the bottom plate 22 of the cooking chamber 20. The discharging port cover 400 prevents foreign substances from moving into the second discharging port 90. For example, the discharging port cover 400 may be used to prevent foreign substances from moving into the second discharging port 90 after the turn table 100 is separated therefrom for cleaning of the cooking chamber 20. That is, the discharging port cover 400 may be optionally used when the cooking chamber 20 is cleaned.

Figure 12:
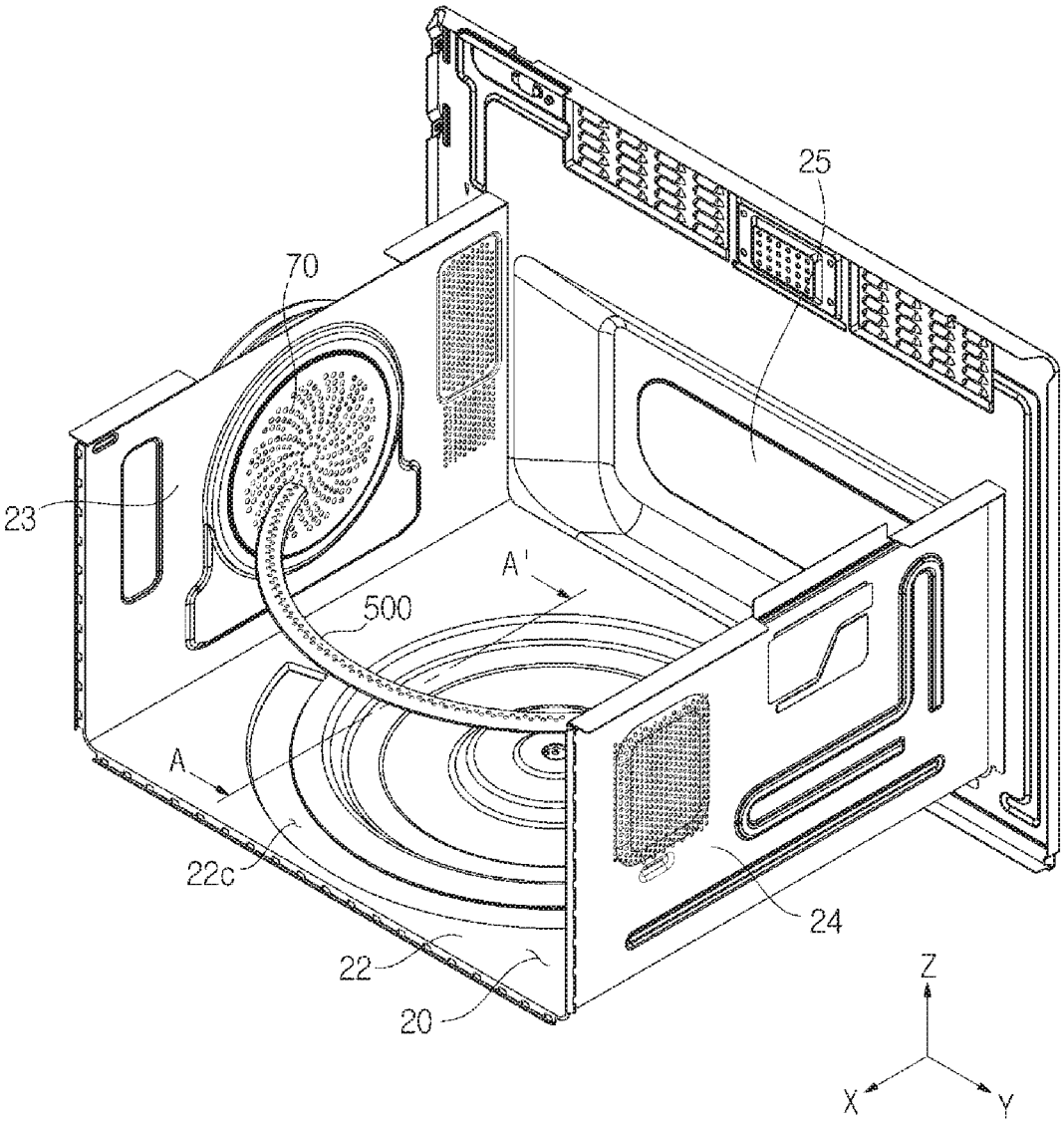
FIG. 12 shows another cooking chamber of an oven, according to an embodiment of the disclosure.

FIG. 12 shows another cooking chamber of an oven, according to an embodiment of the disclosure.

Figure 13A:
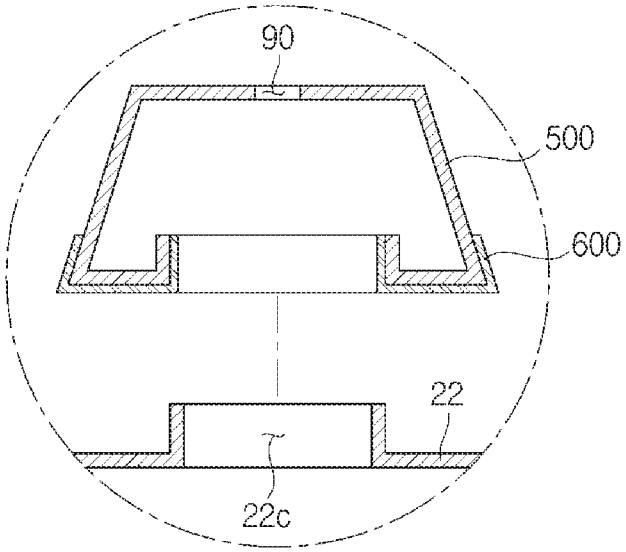
FIGS. 13A and 13B are cross-sectional views of partial configuration of the cooking chamber of FIG. 12 cut along the line A-A', according to various embodiments of the disclosure.
Figure 13B:
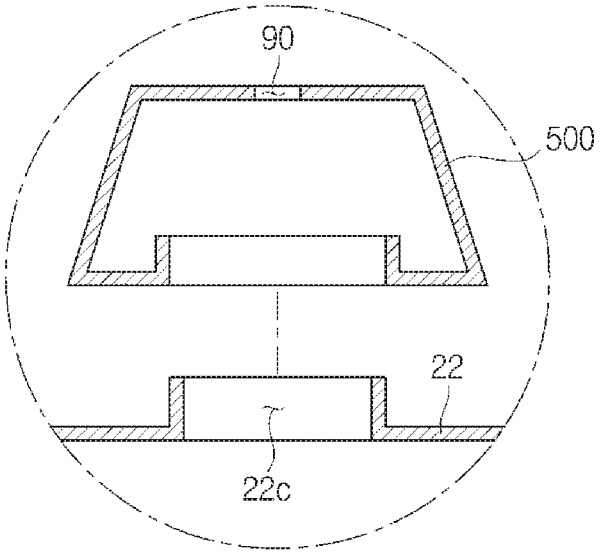

FIGS. 13A and 13B are cross-sectional views of partial configuration of the cooking chamber of FIG. 12 cut along the line A-A', according to various embodiments of the disclosure. Descriptions overlapping with what are described with reference to FIGS. 1 to 7 will not be repeated.

Referring to FIGS. 12 and 13B, a cutting portion 22*c* may be formed on the bottom plate 22 of the cooking chamber 20. The cutting portion 22*c* may be formed on the bottom plate 22 of the cooking chamber 20 to be adjacent to the front of the cooking chamber 20. The cutting portion 22*c* may be formed on the bottom plate 22 of the cooking chamber 30 to be adjacent to the door 30.

The cutting portion 22*c* may communicate with the second discharging duct 230.

The oven 1 may further include a strip 500 detachably coupled to the bottom plate 22 of the cooking chamber 20 to cover the cutting portion 22*c* to define the bottom plate 22 of the cooking chamber 20. The second discharging port 90 may be formed on the strip 500.

With the second discharging port 90 formed on the strip 500 detachably coupled to the bottom plate 22 of the cooking chamber 20, in an occasion when foreign substances move into the second discharging port 90, the second discharging duct 230 may be easily cleaned by separating the strip 500 from the bottom plate 22 of the cooking chamber 20.

The strip 500 may be formed of the same material as the cooking chamber 20 or of an injection molding product.

Referring to FIG. 13A, there may be a sealing member 600 arranged between the cutting portion 22*c* and the strip 500. This is to prevent the strip 500 from being damaged or worn out in the attachment or detachment procedure of the strip 500. Furthermore, the arrangement of the sealing member 600 may prevent the second discharging duct 230 from being contaminated from foreign substances leaking into a possible gap between the cutting portion 22*c* and the strip 500.

The sealing member 600 may be coupled to at least one of the cutting portion 22*c* and the strip 500. For example, the sealing member 600 may be formed of silicon.

Referring to FIG. 13B, both ends of the strip 500 may be bent inwards to the inside of the strip 500. The both ends of the strip 500 may come into surface-to-surface contact with the bottom plate 22 of the cooking chamber 20 around the cutting portion 22*c*, when the strip 500 is coupled with the bottom plate 22 of the cooking chamber 20 to cover the cutting portion 22*c*.

In the case that the second discharging port 90 is formed in the strip 500, the second discharging port 90 is not limited as being located inwards from the edge of the turn table 100 with respect to the rotating shaft 101 of the turn table 100. The second discharging port 90 may be located outside the edge of the turn table 100 with respect to the rotating shaft 101 of the turn table 100.

Figure 14:
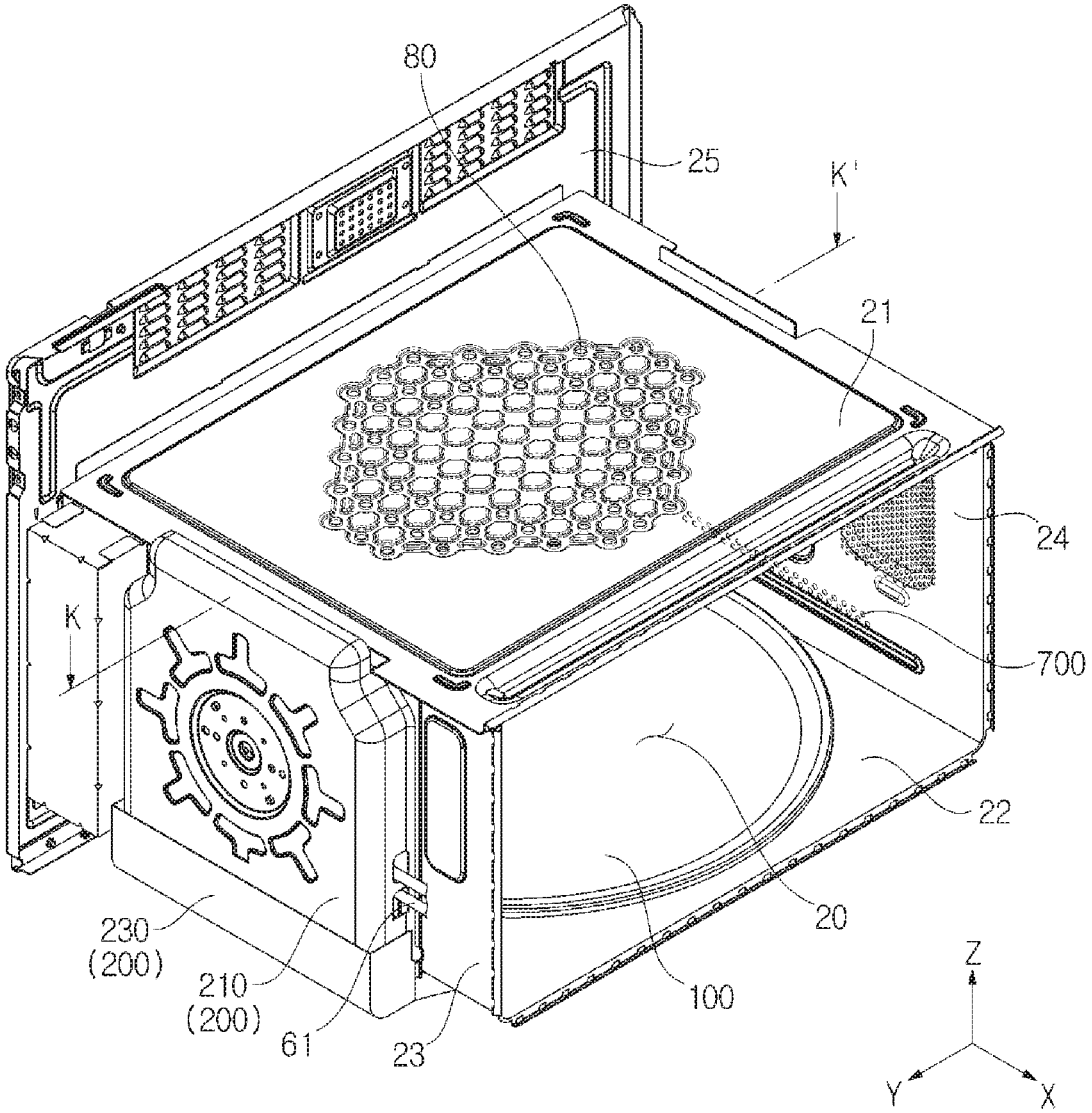
FIG. 14 is a perspective view of another cooking chamber of an oven, according to an embodiment of the disclosure.

FIG. 14 is a perspective view of another cooking chamber of an oven, according to an embodiment of the disclosure.

Figure 15:
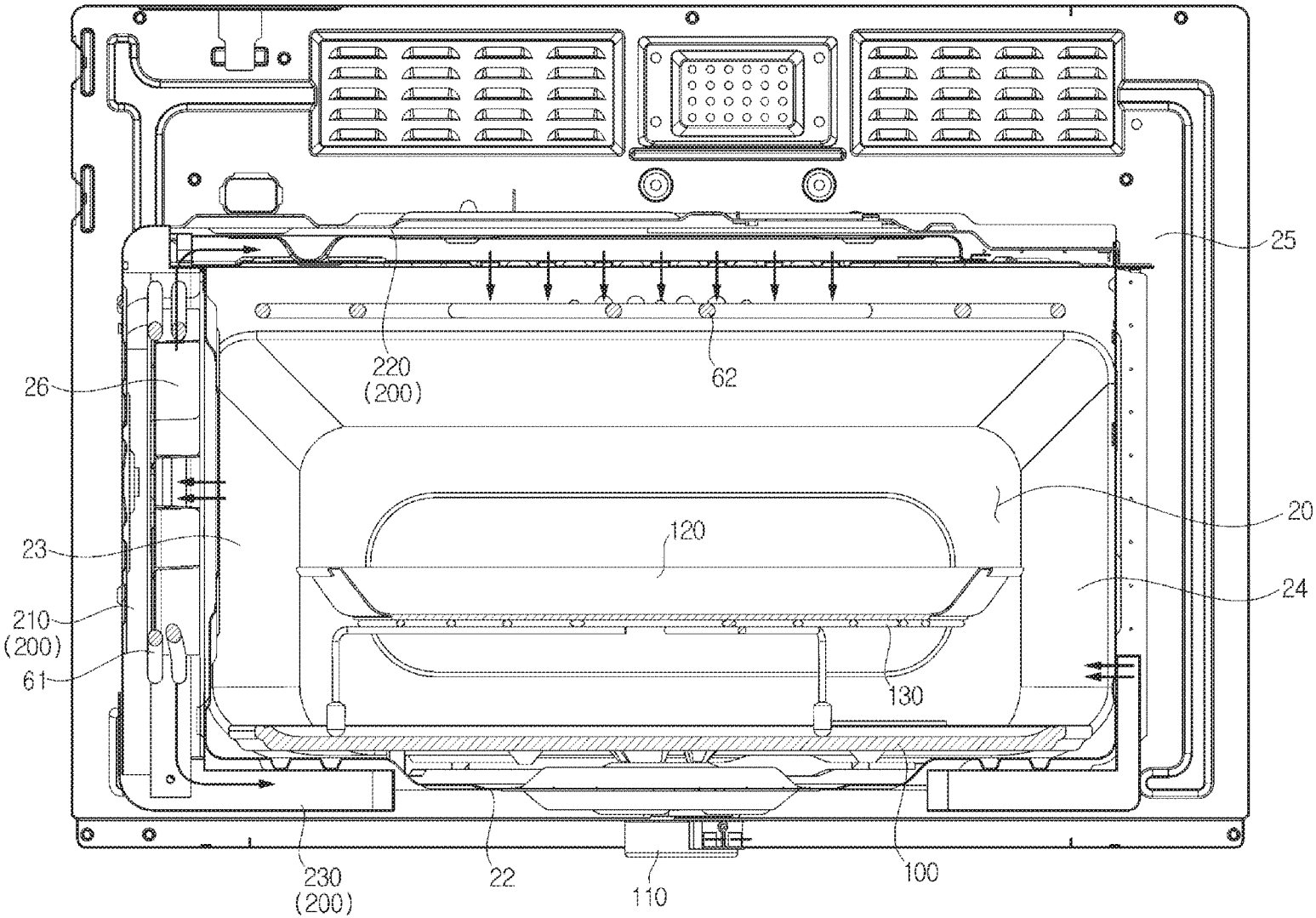
FIG. 15 is a cross-sectional view of the cooking chamber of FIG. 14 cut along the line K-K', according to an embodiment of the disclosure.

FIG. 15 is a cross-sectional view of the cooking chamber of FIG. 14 cut along the line K-K', according to an embodiment of the disclosure.

Figure 16:
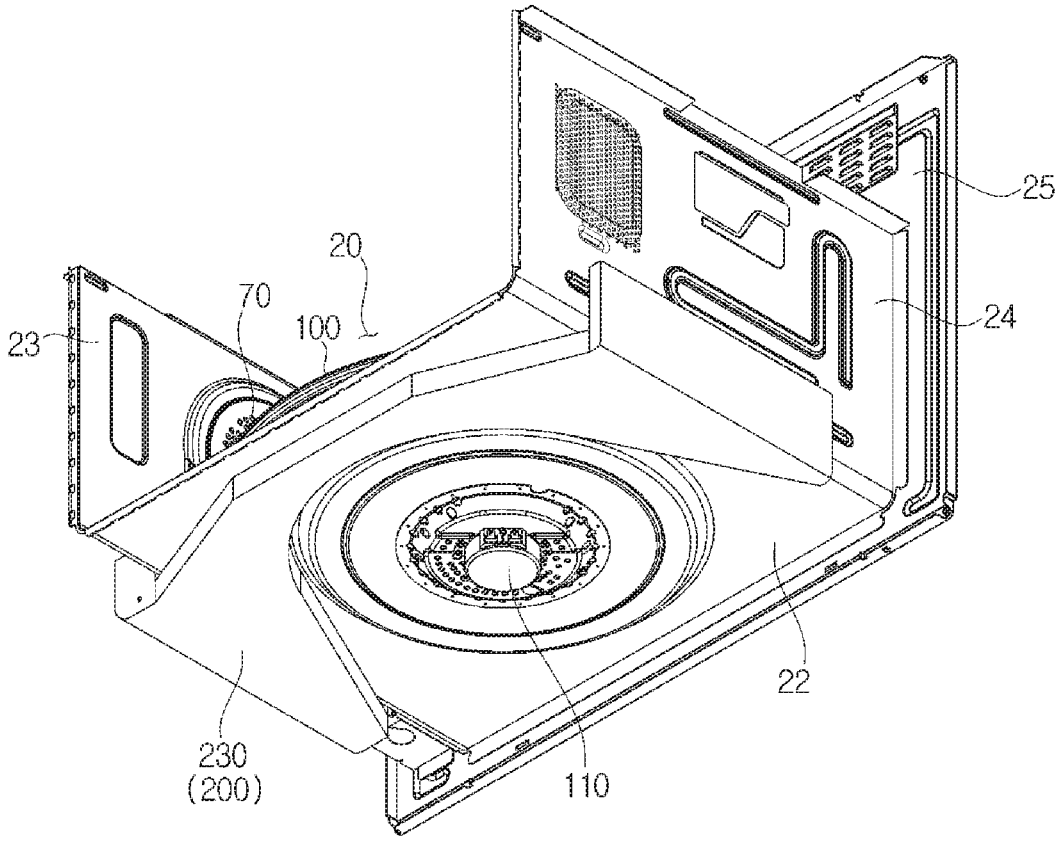
FIG. 16 is a bottom perspective view of the cooking chamber of FIG. 14 of an oven, according to an embodiment of the disclosure.

FIG. 16 is a bottom perspective view of the cooking chamber of FIG. 14 of an oven, according to an embodiment of the disclosure. Descriptions overlapping with what are described with reference to FIGS. 1 to 7 will not be repeated.

Referring to FIGS. 14 to 16, the oven 1 may further include the suction port 70 formed on one wall of the cooking chamber 20. Specifically, the oven 1 may further include a plurality of suction ports 70 formed on one wall of the cooking chamber 20. The suction port 70 may be formed on the right wall 24 or the left wall 23 of the cooking chamber 20.

The oven 1 may further include at least one discharging port 80, 700 formed on other walls of the cooking chamber 20 than a wall having the suction port 70 formed thereon, to discharge the air that has passed through the suction port 70 into the cooking chamber 20.

Of the at least one discharging port 80, 700, there may be the first discharging port 80 formed on a neighboring wall of the cooking chamber 20 to a wall with the suction port 70 formed thereon. For example, the first discharging port 80 may be formed on the top wall 21 of the cooking chamber 20.

Of the at least one discharging port 80, 700, there may be a second discharging port 700 formed on a different wall of the cooking chamber 20 from the walls having the suction port 70 and the first discharging port 80 formed thereon. For example, when the suction port 70 and the first discharging port 80 are formed on the first and second walls of the cooking chamber 20, respectively, the second discharging port 700 may be formed on the third wall of the cooking chamber 20, which is different from the first and second walls. The second discharging port 700 may be formed to be opposite to the suction port 70. The second discharging port 700 may be formed on a wall of the cooking chamber 20 to be opposite to a wall of the cooking chamber 20 having the suction port 70 formed thereon. For example, the second discharging port 700 may be formed on the right wall 24 of the cooking chamber 20 when the suction port 70 is formed on the left wall 23 of the cooking chamber 20, and on the left wall 23 when the suction port 70 is formed on the right wall 24 of the cooking chamber 20.

The oven 1 may further include the circulation duct 200 through which the inside air of the cooking chamber 20 moves around. The circulation duct 200 may be arranged between the main body 10 and the cooking chamber 20 to communicate with the cooking chamber 20. The circulation duct 200 may be arranged outside the cooking chamber 20 to communicate with the cooking chamber 20.

The circulation duct 200 may include the suction duct 210 provided to communicate with the suction port 70. The suction duct 210 may be coupled to one wall of the cooking chamber 20 with the suction port 70 formed thereon. The suction duct 210 may accommodate the circulation fan 26 and the first heater 61. For example, the suction duct 210 may be coupled to the left wall 23 or the right wall 24 of the cooking chamber 20.

The circulation duct 200 may further include the first discharging duct 220 provided to communicate with the first discharging port 80. The first discharging duct 220 may be coupled to an end of the suction duct 210. Specifically, the first discharging duct 220 may be coupled to the upper end of the suction duct 210 to be located on the top wall 21 of the cooking chamber 20. For example, the first discharging duct 220 may be coupled to the top wall 21 of the cooking chamber 20.

The circulation duct 200 may further include the second discharging duct 230 provided to communicate with the second discharging port 700. The second discharging duct 230 may be coupled to the other end of the suction duct 210. Specifically, the second discharging duct 230 may be coupled to the lower end of the suction duct 210 to be located on the bottom plate 22 of the cooking chamber 20 and on a side wall of the cooking chamber 20 with the second suction port 70 formed thereon. The second discharging duct 230 may be fixedly coupled to the bottom plate 22 and the side wall of the cooking chamber 20.

Referring to FIG. 15, as the circulation fan 26 operates, the air inside the cooking chamber 20 moves into the suction duct 210 through the suction port 70. The air moving into the suction duct 210 becomes high temperature air by exchanging heat with the first heater 61. Some of the high temperature air is moved into the first discharging duct 220 and discharged into the cooking chamber 20 through the first discharging port 80. The rest of the high temperature air is moved into the second discharging duct 230 and discharged into the cooking chamber 20 through the second discharging port 700. The object to be cooked may be heated by exchanging heat with the high temperature air discharged into the cooking chamber 20. The high temperature air that has been discharged into the cooking chamber 20 through the first discharging port 80 may further be heated by the optional second heater 62.

Figure 17:
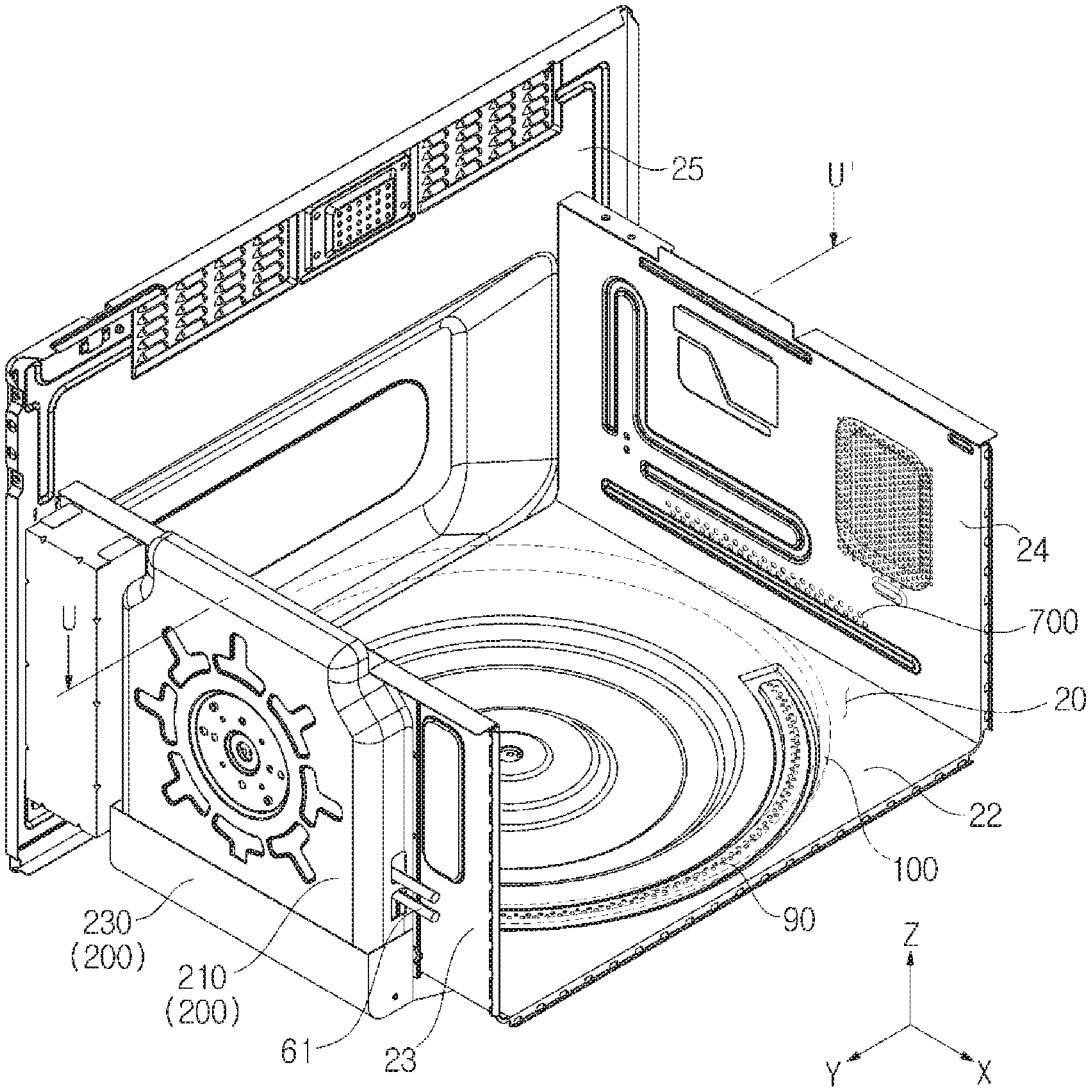
FIG. 17 is a perspective view of another cooking chamber of an oven, according to an embodiment of the disclosure.

FIG. 17 is a perspective view of another cooking chamber of an oven, according to an embodiment of the disclosure.

Figure 18:
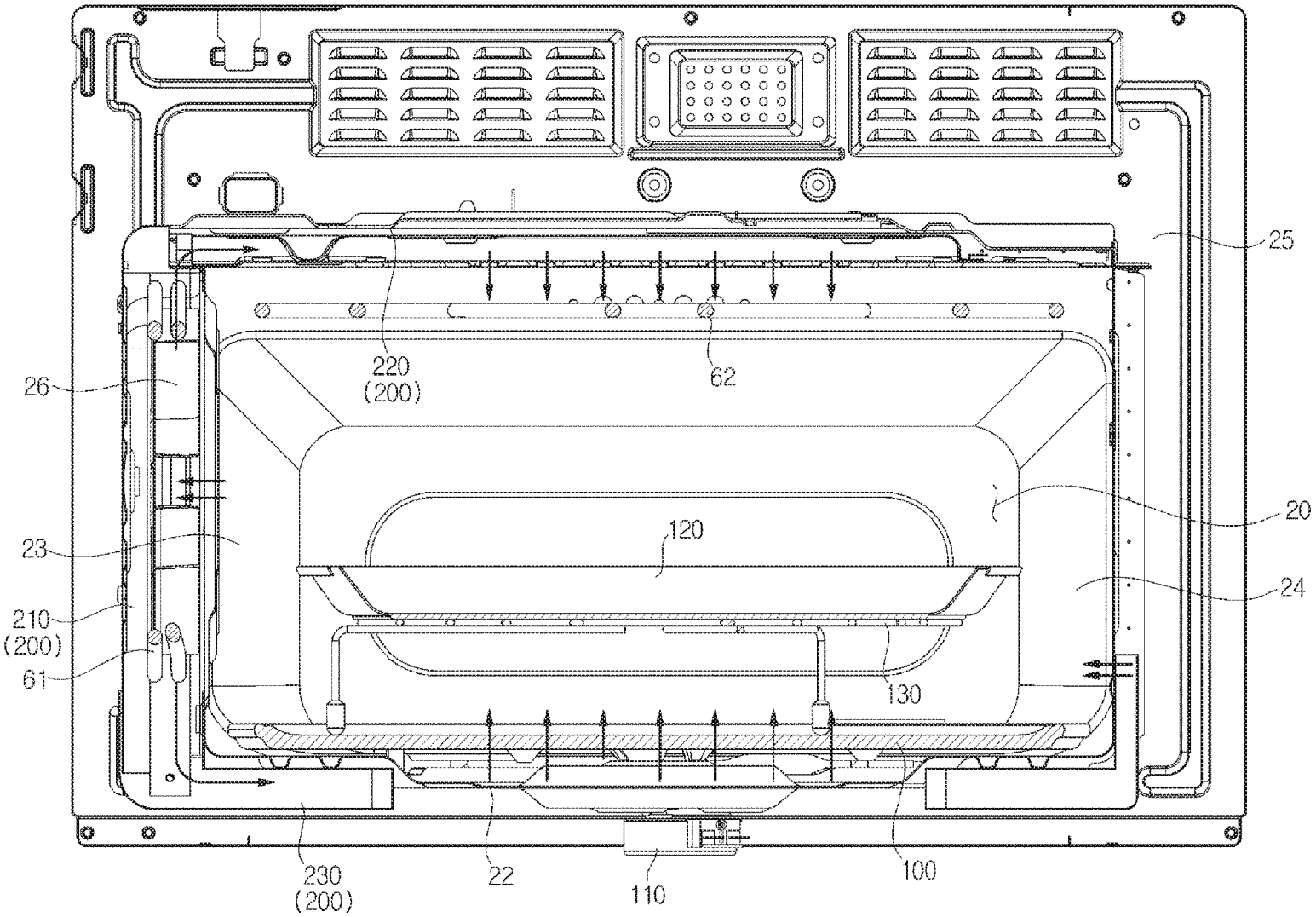
FIG. 18 is a cross-sectional view of the cooking chamber of FIG. 17 cut along the line U-U', according to an embodiment of the disclosure.

FIG. 18 is a cross-sectional view of the cooking chamber of FIG. 17 cut along the line U-U', according to an embodiment of the disclosure. Descriptions overlapping with what are described with reference to FIGS. 1 to 7 will not be repeated.

Referring to FIGS. 17 to 18, the oven 1 may further include the suction port 70 formed on one wall of the cooking chamber 20. Specifically, the oven 1 may further include a plurality of suction ports 70 formed on one wall of the cooking chamber 20. The suction port 70 may be formed on the right wall 24 or the left wall 23 of the cooking chamber 20.

The oven 1 may further include at least one discharging port 80, 90, 700 formed on other walls of the cooking chamber 20 than the wall having the suction port 70 formed thereon, to discharge the air that has passed through the suction port 70 into the cooking chamber 20.

Of the at least one discharging port 80, 90, 700, there may be the first discharging port 80 formed on a neighboring wall of the cooking chamber 20 to the wall having the suction port 70 formed thereon. For example, the first discharging port 80 may be formed on the top wall 21 of the cooking chamber 20.

Of the at least one discharging port 80, 90, 700, there may be the second discharging port 90 formed on a different wall of the cooking chamber 20 from the walls having the suction port 70 and the first discharging port 80 formed thereon. For example, when the suction port 70 and the first discharging port 80 are formed on the first and second walls of the cooking chamber 20, respectively, the second discharging port 90 may be formed on the third wall of the cooking chamber 20, which is different from the first and second walls. The second discharging port 90 may be formed on a neighboring wall of the cooking chamber 20 to the wall of the cooking chamber 20 having the suction port 70 formed thereon. The second discharging port 90 may be formed on a wall of the cooking chamber 20 opposite to the wall of the cooking chamber 20 having the first discharging port 80 formed thereon. The suction port 70 may be located between the first discharging port 80 and the second discharging port 90. For example, the second discharging port 90 may be formed on the bottom plate 22 of the cooking chamber 20. The second discharging port 90 may be formed to be opposite to the turn table 100.

Of the at least one discharging port 80, 90, 700, there may be a third discharging port 700 formed on a different wall of the cooking chamber 20 from the walls having the suction port 70, the first discharging port 80, and the second discharging port 90 formed thereon. For example, when the suction port 70, the first discharging port 80, and the second discharging port 90 are formed on the first, second, and third walls of the cooking chamber 20, respectively, the third discharging port 700 may be formed on the fourth wall of the cooking chamber 20, which is different from the first to third walls. The third discharging port 700 may be formed to be opposite to the suction port 70. The third discharging port 700 may be formed on a wall of the cooking chamber 20 to be opposite to a wall of the cooking chamber 20 having the suction port 70 formed thereon. For example, the third discharging port 700 may be formed on the right wall 24 of the cooking chamber 20 when the suction port 70 is formed on the left wall 23 of the cooking chamber 20, and on the left wall 23 when the suction port 70 is formed on the right wall 24 of the cooking chamber 20.

The oven 1 may further include the circulation duct 200 through which the inside air of the cooking chamber 20 moves around. The circulation duct 200 may be arranged between the main body 10 and the cooking chamber 20 to communicate with the cooking chamber 20. The circulation duct 200 may be arranged outside the cooking chamber 20 to communicate with the cooking chamber 20.

The circulation duct 200 may include the suction duct 210 provided to communicate with the suction port 70. The suction duct 210 may be coupled to one wall of the cooking chamber 20 with the suction port 70 formed thereon. The suction duct 210 may accommodate the circulation fan 26 and the first heater 61. For example, the suction duct 210 may be coupled to the left wall 23 or the right wall 24 of the cooking chamber 20.

The circulation duct 200 may further include the first discharging duct 220 provided to communicate with the first discharging port 80. The first discharging duct 220 may be coupled to an end of the suction duct 210. Specifically, the first discharging duct 220 may be coupled to the upper end of the suction duct 210 to be located on the top wall 21 of the cooking chamber 20. For example, the first discharging duct 220 may be coupled to the top wall 21 of the cooking chamber 20.

The circulation duct 200 may further include the second discharging duct 230 provided to communicate with the second discharging port 90. The second discharging duct 230 may be coupled to the other end of the suction duct 210. Specifically, the second discharging duct 230 may be coupled to the lower end of the suction duct 210 to be located on the bottom plate 22 of the cooking chamber 20. The second discharging duct 230 may be fixedly coupled to the bottom plate 22 of the cooking chamber 20.

One of the first and second discharging ducts 220 and 230 may be provided to further communicate with the third discharging port 700. In a case that the first discharging duct 220 is provided to further communicate with the third discharging port 700, the first discharging duct 220 may link the first and third discharging ports 80 and 700. In a case that the second discharging duct 230 is provided to further communicate with the third discharging port 90, the second discharging duct 230 may link the second and third discharging ports 90 and 700. In the following description, the case where the second discharging duct 230 is provided to further communicate with the third discharging port 700 will be focused.

Referring to FIG. 18, as the circulation fan 26 operates, the air inside the cooking chamber 20 moves into the suction duct 210 through the suction port 70. The air moving into the suction duct 210 becomes high temperature air by exchanging heat with the first heater 61. Some of the high temperature air is moved into the first discharging duct 220 and discharged into the cooking chamber 20 through the first discharging port 80. The rest of the high temperature air is moved into the second discharging duct 230 and discharged into the cooking chamber 20 through the second and third discharging ports 90 and 700. The object to be cooked may be heated by exchanging heat with the high temperature air discharged into the cooking chamber 20. The high temperature air that has been discharged into the cooking chamber 20 through the first discharging port 80 may further be heated by the optional second heater 62.

Figure 19:
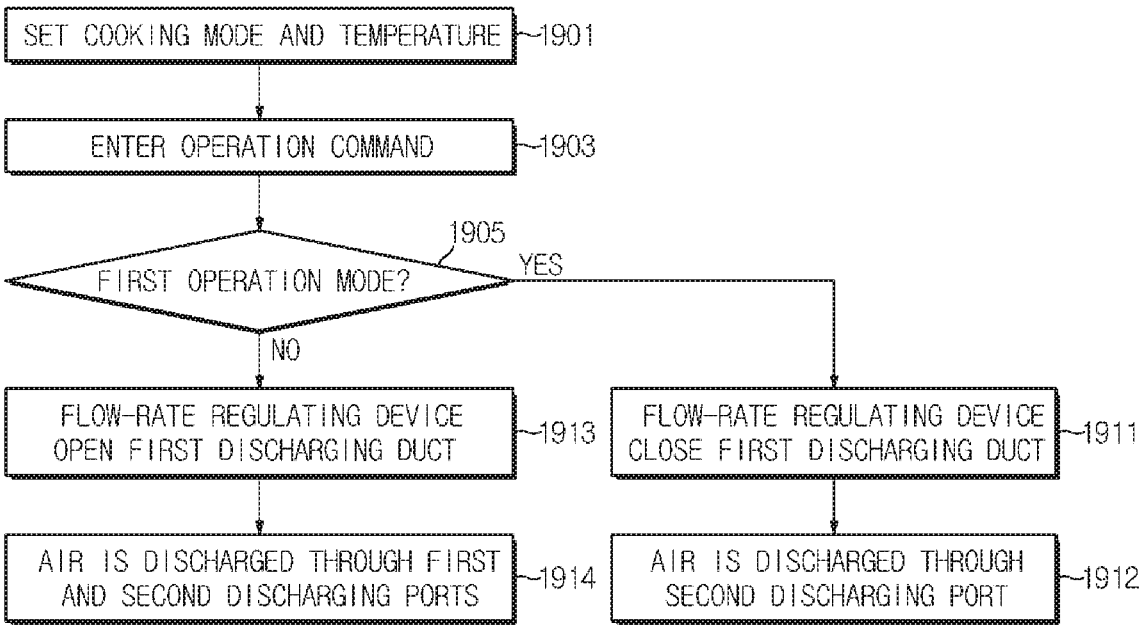
FIG. 19 is a flowchart illustrating a process of regulating an amount of air to be discharged through a first discharging port, which is performed by a flow-rate regulating device of an oven, according to an embodiment of the disclosure.

FIG. 19 is a flowchart illustrating a process of regulating an amount of air to be discharged through a first discharging port, which is performed by a flow-rate regulating device of an oven, according to an embodiment of the disclosure. As illustrated in FIG. 19, at operation 1901, the cooking mode and the temperature are set, at operation 1903, an operation command is entered, and at operation 1905, it is determined whether the entered operation command is a first operation mode. If it is determined that the entered operation command is the first operation mode (at operation 1905), the flow-rate regulating device closes the first discharging duct at operation 1911, and air is discharged through the second discharging port at operation 1912. If it is determined that the entered operation command is not the first operation mode (at operation 1905), the flow-rate regulating device opens the first discharging duct at operation 1913, and air is discharged through the first and second discharging ports at operation 1914.

Figure 20:
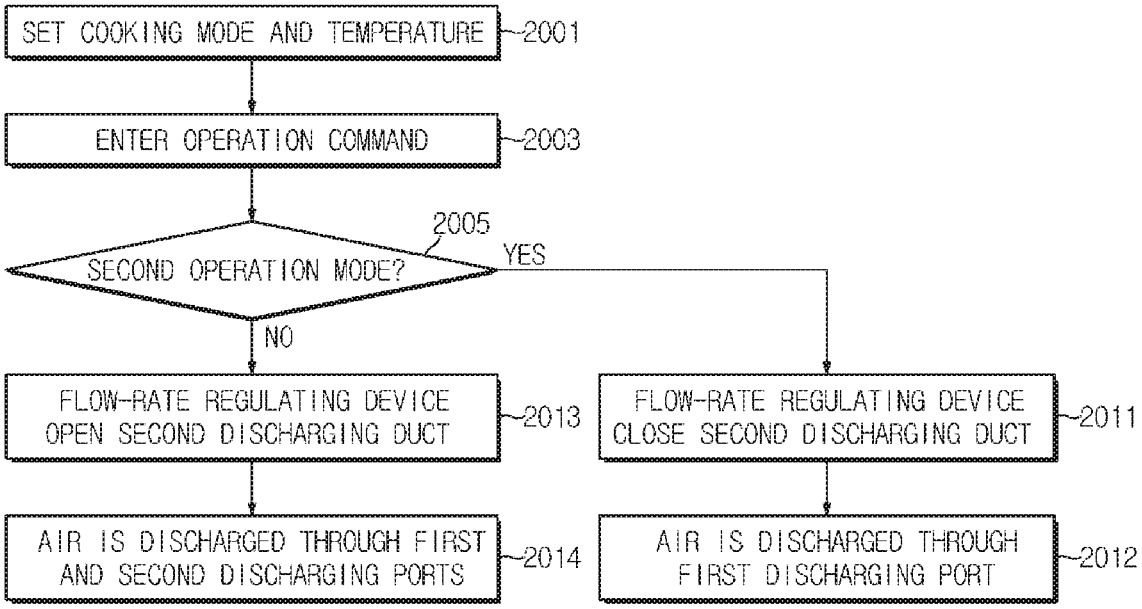
FIG. 20 is a flowchart illustrating a process of regulating an amount of air to be discharged through a second discharging port, which is performed by a flow-rate regulating device of an oven, according to an embodiment of the disclosure.

FIG. 20 is a flowchart illustrating a process of regulating an amount of air to be discharged through a second discharging port, which is performed by a flow-rate regulating device of an oven, according to an embodiment of the disclosure. As illustrated in FIG. 20, at operation 2001, the cooking mode and the temperature are set, at operation 2003, an operation command is entered, and at operation 2005, it is determined whether the entered operation command is a second operation mode. If it is determined that the entered operation command is the second operation mode (at operation 2005), the flow-rate regulating device closes the second discharging duct at operation 2011, and air is discharged through the first discharging port at operation 2012. If it is determined that the entered operation command is not the second operation mode (at operation 2005), the flow-rate regulating device opens the second discharging duct at operation 2013, and air is discharged through the first and second discharging ports at operation 2014.

Figure 21:
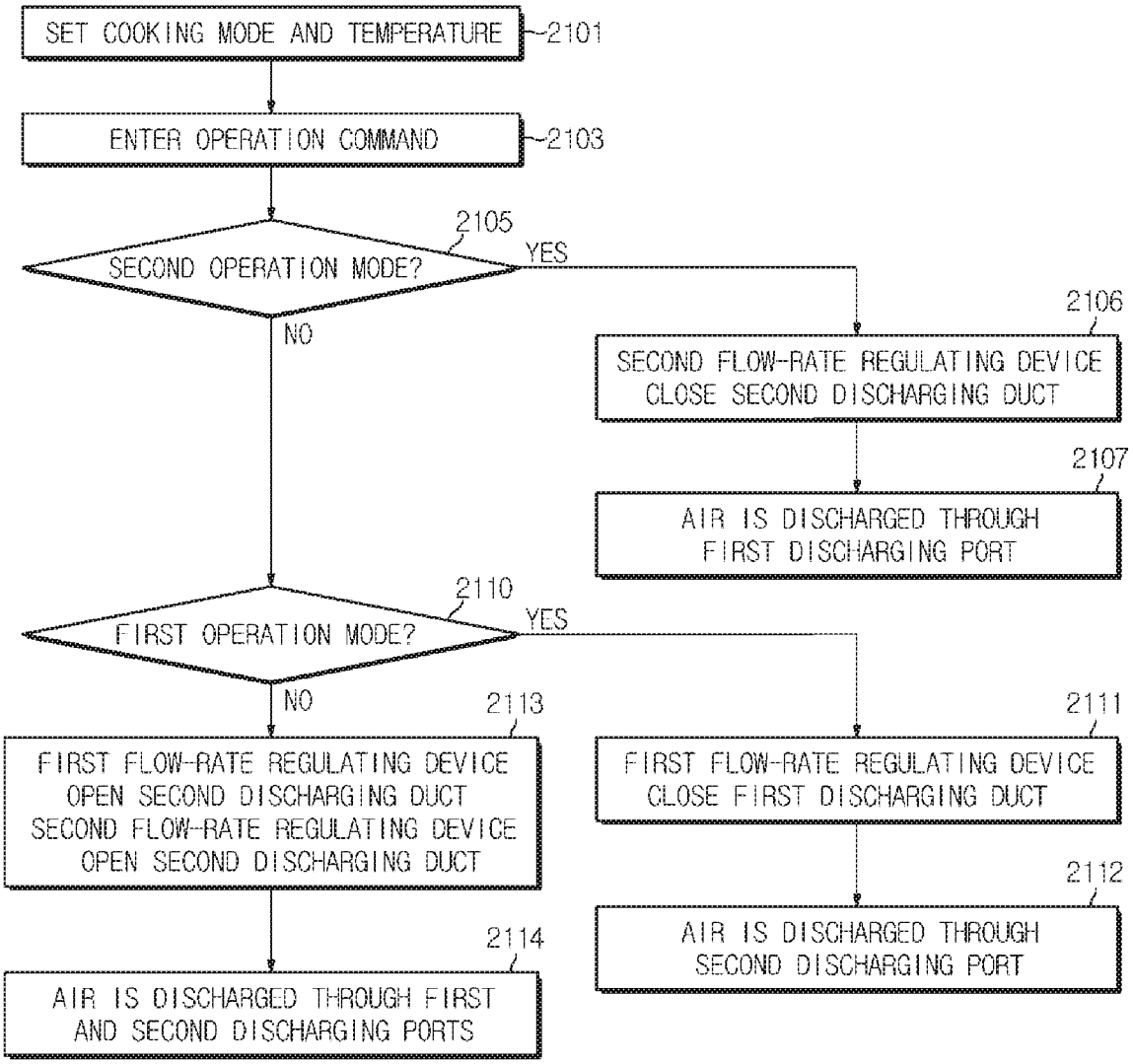
FIG. 21 is a flowchart illustrating a process of regulating an amount of air to be discharged through first and second discharging ports, which is performed by a plurality of flow-rate regulating devices of an oven, according to an embodiment of the disclosure.

FIG. 21 is a flowchart illustrating a process of regulating an amount of air to be discharged through first and second discharging ports, which is performed by a plurality of flow-rate regulating devices of an oven, according to an embodiment of the disclosure. As illustrated in FIG. 21, at operation 2101, the cooking mode and the temperature are set, at operation 2103, an operation command is entered, and at operation 2105, it is determined whether the entered operation command is the second operation mode. If it is determined that the entered operation command is the second operation mode (at operation 2105), the second flow-rate regulating device closes the second discharging duct at operation 2106, and air is discharged through the first discharging port at operation 2107. If it is determined that the entered operation command is not the second operation mode (at operation 2105), it is then determined whether the entered operation is the first operation mode, at operation 2110. If it is determined that the entered operation mode is the first operation mode (at operation 2110), the first flow-rate regulating device closes the first discharging duct, at operation 2111, and air is discharged through the second discharging port, at operation 2112. If it is determined that the entered operation mode is not the first operation mode (at operation 2110), the first flow-rate regulating device opens the second discharging duct, and the second flow-rate regulating device opens the second discharging duct, at operation 2113, and air is discharged through the first and second discharging ports at operation 2114. Descriptions overlapping with what are described with reference to FIGS. 1 to 7 will not be repeated.

Referring to FIGS. 5 to 19, a flow-rate regulating device may be arranged at a first position q1 in the circulation duct 200. Specifically, the flow-rate regulating device may be arranged in the first discharging duct 220 or in the suction duct 210 to be adjacent to the first discharging duct 220, in order to open or close the first discharging duct 220. An operation command is entered after a cooking mode and temperature are set. In a first operation mode in which the first heater 61 is mainly operated, the flow-rate regulating device closes the first discharging duct 220. At this time, the air heated by the first heater 61 may be discharged into the cooking chamber 20 through the second discharging port 90. Otherwise, in other mode than the first operation mode where the first heater 61 is mainly operated, the flow-rate regulating device opens the first discharging duct 220. At this time, the air heated by the first heater 61 may be discharged into the cooking chamber 20 through the first and second discharging ports 80 and 90. Hereinafter, the first operation mode may be termed as a "convention mode".

Referring to FIGS. 5 to 20, a flow-rate regulating device may be arranged at a second position q2 in the circulation duct 200. Specifically, the flow-rate regulating device may be arranged in the second discharging duct 230 or in the suction duct 210 to be adjacent to the second discharging duct 230, in order to open or close the second discharging duct 230. An operation command is entered after a cooking mode and temperature are set. In a second operation mode in which the second heater 62 is mainly operated, the flow-rate regulating device closes the second discharging duct 230. At this time, the air heated by the first heater 61 may be discharged into the cooking chamber 20 through the first discharging port 80. The air that has been discharged into the cooking chamber 20 through the first discharging port 80 may be secondarily heated by the second heater 62. Otherwise, in other mode than the second operation mode where the second heater 62 is mainly operated, the flow-rate regulating device opens the second discharging duct 230. At this time, the air heated by the first heater 61 may be discharged into the cooking chamber 20 through the first and second discharging ports 80 and 90. Hereinafter, the second operation mode may be termed as a "hot blast mode".

Referring to FIGS. 5 to 21, flow-rate regulating devices may be arranged at the first and second positions q1 and q2 in the circulation duct 200. Specifically, the flow-rate regulating devices may include a first flow-rate regulating device arranged in the first discharging duct 220 or in the suction duct 210 to be adjacent to the first discharging duct 220 in order to open or close the first discharging duct 220, and a second flow-rate regulating device arranged in the second discharging duct 230 or in the suction duct 210 to be adjacent to the second discharging duct 230 in order to open or close the second discharging duct 230. An operation command is entered after a cooking mode and temperature are set. In the second operation mode in which the second heater 62 is mainly operated, the second flow-rate regulating device closes the second discharging duct 230. At this time, the air heated by the first heater 61 may be discharged into the cooking chamber 20 through the first discharging port 80. The air that has been discharged into the cooking chamber 20 through the first discharging port 80 may be secondarily heated by the second heater 62. Not in the second operation mode in which the second heater 62 is mainly operated but in the first operation mode in which the first heater 61 is mainly operated, the first flow-rate regulating device closes the first discharging duct 220. At this time, the air heated by the first heater 61 may be discharged into the cooking chamber 20 through the second discharging port 90. Not in the second operation mode in which the second heater 62 is mainly operated nor in the first operation mode in which the first heater 61 is mainly operated, the first flow-rate regulating device opens the first discharging duct 220 and the second flow-rate regulating device opens the second discharging duct 230. At this time, the air heated by the first heater 61 may be discharged into the cooking chamber 20 through the first and second discharging ports 80 and 90.

According to embodiments of the disclosure, a discharging port for discharging heated air into a cooking chamber is formed on the bottom plate of the cooking chamber, making the bottom plate, which is somewhat hardly heated, sufficiently heated.

Furthermore, the discharging port for discharging heated air into the cooking chamber is formed on the bottom plate of the cooking chamber to be adjacent to the door, thereby effectively eliminating moisture that may be formed on the door.

Moreover, a suction port and a discharging port are formed on different walls of the cooking chamber, thereby preventing the air discharged into the cooking chamber through the discharging port from moving out of the cooking chamber through the suction port without sufficiently heating the cooking chamber.

In addition, a plurality of discharging ports is formed on different walls of the cooking chamber, thereby increasing a flow rate of air circulating in the cooking chamber to heat the cooking chamber.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An oven comprising:

a main body;

a cooking chamber arranged inside the main body, the cooking chamber including a front, that is open;

a door arranged to open or close the front of the cooking chamber;

a circulation fan arranged to circulate air in the cooking chamber;

a suction port formed on a wall of the cooking chamber facing the circulation fan;

a turn table arranged on a bottom plate of the cooking chamber, the turn table being rotatable around a rotating shaft;

a discharging port formed on the bottom plate of the cooking chamber, the discharging port for discharging air that has passed through the suction port into the cooking chamber, the discharging port being located under the turn table; and a first flow-rate regulating device and a second flow-rate regulating device that are configured to open and close, the first flow-rate regulating device positioned between the circulation fan and the discharging port, wherein, in case air is discharged through the discharging port, the first flow-rate regulating device is open and the second flow-rate regulating device is closed.

2. The oven of claim 1, wherein the discharging port is formed in a front portion of the bottom plate of the cooking chamber to be adjacent to the door.

3. The oven of claim 1, wherein the discharging port is located inwards from edges of the turn table with respect to the rotating shaft of the turn table.

4. The oven of claim 1, further comprising:

a suction duct arranged to communicate with the suction port, the suction duct accommodating the circulation fan therein; and a discharging duct coupled to an outside of the bottom plate of the cooking chamber, the discharging duct in communication with the discharging port and coupled to the suction duct.

5. The oven of claim 4, wherein the discharging duct comprises a curved portion bulging toward the front of the cooking chamber.

6. The oven of claim 4, wherein at least a portion of the discharging duct is enclosed by one or more heat insulating materials.

7. The oven of claim 1, wherein the bottom plate of the cooking chamber comprises:

a first sector having the discharging port formed therein, and a second sector concavely formed therein, and wherein the oven further comprises:

a dust collector provided to link the first sector and the second sector to guide foreign substances into the second sector.

8. The oven of claim 7, wherein the dust collector includes a depth less than a depth of the second sector.

9. The oven of claim 7, wherein the dust collector comprises:

a first collector formed to enclose the first sector; and a second collector linking the first collector and the second sector.

10. The oven of claim 1, further comprising:

a discharging port cover detachably coupled to the bottom plate of the cooking chamber to cover the discharging port.

11. The oven of claim 1, further comprising:

a cutting portion formed on the bottom plate of the cooking chamber; and a strip detachably coupled to the bottom plate of the cooking chamber to define the bottom plate of the cooking chamber by covering the cutting portion, and including the discharging port formed thereon.

12. The oven of claim 11, wherein at least one of the cutting portion or the strip is coupled with a sealing member.

13. An oven comprising:

a main body;

a cooking chamber arranged inside the main body, the cooking chamber including a front that is open;

a door arranged to open or close the front of the cooking chamber;

a suction port formed on a first wall of the cooking chamber;

a first discharging port formed on a second wall of the cooking chamber;

a second discharging port formed on a third wall of the cooking chamber; and a circulation duct arranged between the main body and the cooking chamber, the circulation duct in communication with the cooking chamber; and a first flow-rate regulating device and a second flow-rate regulating device that are configured to open and close, wherein the first flow-rate regulating device is positioned between the circulation duct and the first discharging port, and the first flow-rate regulating device is positioned between the circulation duct and the second discharging port, and wherein, in case air is discharged through the first discharging port, the first flow-rate regulating device is open and the second flow-rate regulating device is closed.

14. The oven of claim 13, wherein the suction port is located between the first discharging port and the second discharging port.

15. The oven of claim 13, wherein the circulation duct comprises:

a suction duct in communication with the suction port;

a first discharging duct coupled to a first end of the suction duct, the first discharging duct in communication with the first discharging port; and a second discharging duct coupled to a second end of the suction duct, the second discharging duct in communication with the second discharging port.

16. The oven of claim 15, further comprising:

a third discharging port formed on a fourth wall of the cooking chamber.

17. The oven of claim 16, wherein at least one of the first discharging duct or the second discharging duct is in communication with the third discharging port.

18. The oven of claim 16, wherein the third discharging port faces the suction port.

19. The oven of claim 13, wherein at least a portion of the circulation duct is enclosed by one or more heat insulating materials.

20. An oven comprising:

a main body;

a cooking chamber arranged inside the main body, the cooking chamber including a front that is open;

a door arranged to open or close the front of the cooking chamber;

a suction port formed on a side wall of the cooking chamber;

a first discharging port formed on a top wall of the cooking chamber;

a second discharging port formed on a bottom plate of the cooking chamber;

a circulation duct in communication with the suction port, the first discharging port, and the second discharging port;

at first flow-rate regulating decide and a second flow-rate regulating device that are configured to open and close, wherein the first flow-rate regulating device is positioned between the circulation duct and the first discharging port, and the first flow-rate regulating device is positioned between the circulation duct and the second discharging port, and wherein an amount of air discharged into the cooking chamber through at least one of the first discharging port or the second discharging port is controlled by opening or closing the first flow-rate regulating device and the second flow-rate regulating device.

* * * * *